US009170511B2

(12) United States Patent
Moritani et al.

(10) Patent No.: US 9,170,511 B2
(45) Date of Patent: Oct. 27, 2015

(54) TONER, DEVELOPMENT AGENT, AND IMAGE FORMING APPARATUS

(71) Applicants: Tatsuru Moritani, Shizuoka (JP); Yoshihiro Moriya, Shizuoka (JP); Hiroshi Yamada, Shizuoka (JP); Ryota Inoue, Shizuoka (JP); Shinya Nakayama, Shizuoka (JP); Atsushi Yamamoto, Osaka (JP)

(72) Inventors: Tatsuru Moritani, Shizuoka (JP); Yoshihiro Moriya, Shizuoka (JP); Hiroshi Yamada, Shizuoka (JP); Ryota Inoue, Shizuoka (JP); Shinya Nakayama, Shizuoka (JP); Atsushi Yamamoto, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/208,355

(22) Filed: Mar. 13, 2014

(65) Prior Publication Data

US 2014/0272695 A1 Sep. 18, 2014

(30) Foreign Application Priority Data

Mar. 14, 2013 (JP) ..... 2013-051168

(51) Int. Cl.

*G03G 9/08* (2006.01)
*G03G 9/087* (2006.01)
*G03G 9/093* (2006.01)

(52) U.S. Cl.

CPC ..... *G03G 9/08764* (2013.01); *G03G 9/0821* (2013.01); *G03G 9/08711* (2013.01); *G03G 9/08728* (2013.01); *G03G 9/08755* (2013.01); *G03G 9/08795* (2013.01); *G03G 9/08797* (2013.01); *G03G 9/09314* (2013.01); *G03G 9/09328* (2013.01); *G03G 9/09371* (2013.01); *G03G 9/09392* (2013.01)

(58) Field of Classification Search

CPC ..... G03G 9/08711; G03G 9/09314; G03G 9/0821
USPC ..... 430/109.3, 110.2, 111.4
See application file for complete search history.

(56) References Cited

U.S. PATENT DOCUMENTS

| | | | |
|---|---|---|---|
| 2003/0138717 | A1 | 7/2003 | Yagi et al. |
| 2003/0180644 | A1 | 9/2003 | Nanya et al. |
| 2004/0072091 | A1 | 4/2004 | Mochizuki et al. |
| 2004/0115550 | A1 | 6/2004 | Sugiura et al. |
| 2004/0131961 | A1 | 7/2004 | Watanabe et al. |
| 2005/0026064 | A1 | 2/2005 | Sugiura et al. |
| 2005/0026066 | A1 | 2/2005 | Tanaka et al. |
| 2005/0031980 | A1 | 2/2005 | Inoue et al. |
| 2005/0089786 | A1 | 4/2005 | Sugiura et al. |
| 2005/0089787 | A1 | 4/2005 | Uchinokura et al. |
| 2005/0112488 | A1 | 5/2005 | Yamada et al. |
| 2005/0164112 | A1 | 7/2005 | Ohki et al. |
| 2005/0164114 | A1 | 7/2005 | Yagi et al. |
| 2005/0208408 | A1 | 9/2005 | Uchinokura et al. |

(Continued)

FOREIGN PATENT DOCUMENTS

| | | |
|---|---|---|
| JP | 2004-038115 | 2/2004 |
| JP | 2006-276305 | 10/2006 |

(Continued)

*Primary Examiner* — Mark A Chapman
(74) *Attorney, Agent, or Firm* — Oblon, McClelland, Maier & Neustadt, L.L.P.

(57) ABSTRACT

Toner contains a binder resin containing one or more kinds of crystalline resin and one or more kinds of non-crystalline resin. The non-crystalline resin located at the surface portion of the toner forms a shell structure of a continuous phase of the non-crystalline resin and the toner has an amount of melting heat of 30 J/g or more in a second temperature rising as measured by differential scanning calorimetry (DSC).

16 Claims, 14 Drawing Sheets

(56) References Cited

U.S. PATENT DOCUMENTS

| | | | |
|---|---|---|---|
| 2006/0029433 | A1 | 2/2006 | Saito et al. |
| 2006/0046174 | A1 | 3/2006 | Ohki et al. |
| 2006/0057488 | A1 | 3/2006 | Inoue et al. |
| 2006/0063081 | A1 | 3/2006 | Nagatomo et al. |
| 2006/0063089 | A1 | 3/2006 | Tanaka et al. |
| 2006/0068312 | A1 | 3/2006 | Yamashita et al. |
| 2006/0099529 | A1 | 5/2006 | Tanaka et al. |
| 2006/0160011 | A1 | 7/2006 | Inoue et al. |
| 2006/0210903 | A1 | 9/2006 | Ohki et al. |
| 2006/0240349 | A1 | 10/2006 | Watanabe et al. |
| 2006/0240351 | A1 | 10/2006 | Sugiura et al. |
| 2006/0251979 | A1 | 11/2006 | Watanabe et al. |
| 2007/0031748 | A1 | 2/2007 | Kotsugai et al. |
| 2007/0031752 | A1 | 2/2007 | Watanabe et al. |
| 2007/0059626 | A1 | 3/2007 | Inoue et al. |
| 2007/0141506 | A1 | 6/2007 | Inoue et al. |
| 2008/0014527 | A1 | 1/2008 | Kotsugai et al. |
| 2008/0090165 | A1 | 4/2008 | Yamada et al. |
| 2008/0118855 | A1 | 5/2008 | Nakayama et al. |
| 2008/0227002 | A1 | 9/2008 | Moriya et al. |
| 2008/0233498 | A1 | 9/2008 | Yamada et al. |
| 2008/0261131 | A1 | 10/2008 | Nakayama et al. |
| 2008/0280218 | A1 | 11/2008 | Sabu et al. |
| 2008/0280219 | A1 | 11/2008 | Nakayama et al. |
| 2008/0318143 | A1 | 12/2008 | Nakayama et al. |
| 2009/0053644 | A1* | 2/2009 | Sacripante ..... 430/137.13 |
| 2009/0117480 | A1 | 5/2009 | Yamada et al. |
| 2010/0104965 | A1 | 4/2010 | Inoue et al. |
| 2010/0129748 | A1 | 5/2010 | Inoue et al. |
| 2010/0183967 | A1 | 7/2010 | Sabu et al. |
| 2010/0330489 | A1 | 12/2010 | Inoue et al. |
| 2011/0065036 | A1 | 3/2011 | Inoue et al. |
| 2011/0104608 | A1 | 5/2011 | Nakajima et al. |
| 2011/0124838 | A1 | 5/2011 | Kotsugai et al. |
| 2011/0223530 | A1 | 9/2011 | Inoue et al. |
| 2011/0281213 | A1 | 11/2011 | Sakashita et al. |
| 2012/0282000 | A1 | 11/2012 | Nakayama et al. |
| 2012/0295188 | A1 | 11/2012 | Nakajima et al. |
| 2013/0045442 | A1 | 2/2013 | Moriya et al. |
| 2013/0065172 | A1 | 3/2013 | Moriya et al. |
| 2013/0078563 | A1 | 3/2013 | Nakayama et al. |
| 2013/0095422 | A1 | 4/2013 | Yamamoto et al. |
| 2013/0108950 | A1 | 5/2013 | Yamamoto et al. |
| 2013/0115550 | A1 | 5/2013 | Amemori et al. |
| 2013/0143155 | A1 | 6/2013 | Santo et al. |
| 2013/0149642 | A1 | 6/2013 | Sabu et al. |
| 2013/0157183 | A1 | 6/2013 | Santo et al. |
| 2013/0157185 | A1 | 6/2013 | Sakashita et al. |
| 2013/0157193 | A1 | 6/2013 | Moritani et al. |
| 2013/0171550 | A1 | 7/2013 | Amemori et al. |
| 2013/0202996 | A1 | 8/2013 | Yamauchi et al. |
| 2013/0236826 | A1 | 9/2013 | Makabe et al. |
| 2013/0236828 | A1 | 9/2013 | Mizoguchi et al. |
| 2013/0244011 | A1 | 9/2013 | Sabu et al. |
| 2013/0244153 | A1 | 9/2013 | Nakayama et al. |
| 2013/0244154 | A1 | 9/2013 | Yamamoto et al. |
| 2013/0244167 | A1 | 9/2013 | Yamashita et al. |
| 2013/0244168 | A1 | 9/2013 | Yamashita et al. |
| 2013/0252158 | A1 | 9/2013 | Yamada et al. |
| 2013/0260298 | A1 | 10/2013 | Amemori et al. |

FOREIGN PATENT DOCUMENTS

| | | |
|---|---|---|
| JP | 2009-014926 | 1/2009 |
| JP | 2009-053695 | 3/2009 |
| JP | 2010-077419 | 4/2010 |
| JP | 2010-151996 | 7/2010 |
| JP | 2010-276754 | 12/2010 |
| JP | 2012-083661 | 4/2012 |
| JP | 2012-128404 | 7/2012 |

* cited by examiner

TONER, DEVELOPMENT AGENT, AND IMAGE FORMING APPARATUS

CROSS-REFERENCE TO RELATED APPLICATIONS

This patent application is based on and claims priority pursuant to 35 U.S.C. §119 to Japanese Patent Application No. 2013-051168 filed on Mar. 14, 2013, in the Japan Patent Office, the entire disclosure of which is hereby incorporated by reference herein.

BACKGROUND

1. Technical Field

The present invention is related to toner, a development agent, and an image forming apparatus.

2. Background Art

Latent images formed electrically or magnetically are typically rendered visible by an electrophotographic image forming apparatus using toner (electrophotographic toner). For example, in electrophotography, electrostatic images (latent images) are formed on an image bearing member (typically a photoreceptor) and developed with toner to form visible toner images. The visible toner image is then transferred onto a transfer medium, typically paper, and thereafter fixed thereon. In the fixing process in which the toner image is fixed on the transfer medium, a thermal fixing device such as a heating roller fixing system or a heating belt fixing system is generally used for better energy efficiency.

In the current market, toner is demanded to have good low temperature fixability for energy saving.

To improve the low temperature fixability of toner, it is necessary to control the thermal characteristics of the binder resin accounting for a large ratio of the toner. In efforts to meet such an demand, for example, JP-2010-077419-A, JP-2012-083661-A, JP-2009-53695-A, and JP-2010-276754-A disclose regulating the composition and the thermal characteristics of a crystalline resin or toner having a good combination of low temperature fixability and high temperature stability of by providing a layer formed of particulates to the surface of the toner.

In addition, JP-2009-014926-A describes using a toner containing a binder resin formed of two kinds of crystalline resins (particularly preferably crystalline polyester resins) having different molecular weights under a particular fixing condition to improve the low temperature fixability of toner and prevent fixed images from cracking. In addition, JP-2010-151996-A discloses a toner containing a binder resin formed of two kinds of crystalline resins having different storage elastic moduli at 160° C. to have a good combination of low temperature fixability and high pressure stability.

However, in toner having a binder resin containing a crystalline resin, if the content of the crystalline resin accounts for a large ratio in the binder resin, the toner has an excellent low temperature fixability but with problems such that the toner is vulnerable to stirring stress in a development device, which easily leads to agglomeration of the toner and carrier over time, resulting in production of deficient images and in addition, it takes a time for re-crystallization of toner melted on a transfer medium during thermal fixing, meaning that the hardness of the surface of an image is not regained soon. These problems are ascribable to the properties of the crystalline resin. For this reason, marks of a member such as a discharging roller arranged in a discharging or transfer path are formed on the surface of an image after fixing, resulting in gloss change or damage thereof.

In attempts to solve these problems, for example, JP-3949526-B1 (JP-2004-038115-A) and JP-4513627-B1 (JP-2006-276305-A1) disclose a combinational use of a crystalline resin and a non-crystalline resin instead of using only a crystalline resin as the main component of a binder resin.

These are successful in compensating the defect about the hardness of the crystalline resin but are not satisfactory about improvement of the low temperature fixability thereby.

SUMMARY

The present invention provides improved toner having a binder resin containing one or more kinds of crystalline resin and one or more kinds of non-crystalline resin. The non-crystalline resin located at the surface portion of the toner forms a shell structure of a continuous phase of the non-crystalline resin and the toner has an amount of melting heat of 30 J/g or more in a second temperature rising as measured by differential scanning calorimetry (DSC).

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

Figure 1:
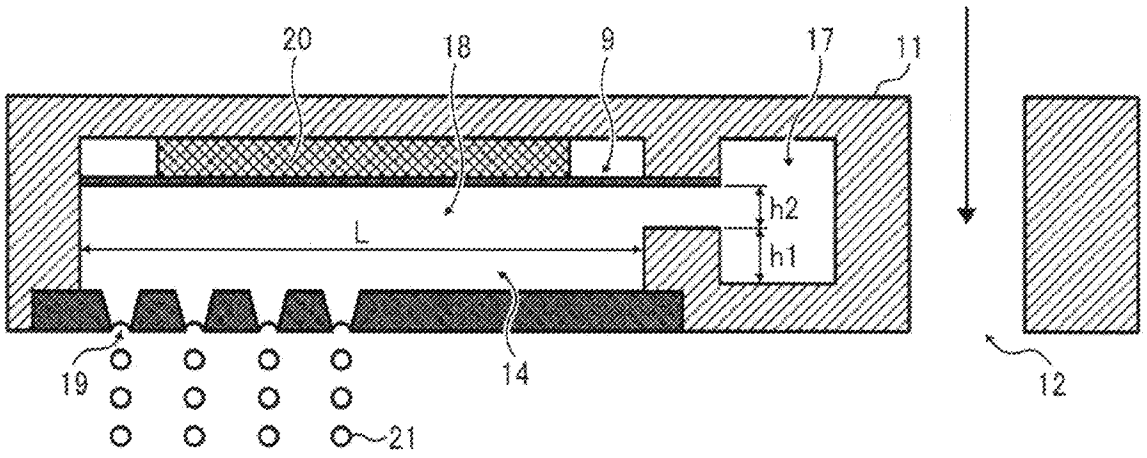
FIG. 1 is a cross section illustrating a liquid column resonance type droplet ejecting device.

The present invention is to provide toner that prevents damage to an image from occurring during recrystallization in a transfer path immediately after fixing while striking a balance between low temperature fixability and stress resistance.

Embodiments of the present disclosure are described below with reference to accompanying drawings It is to be noted that it will be apparent to one of ordinary skill in the art that many suitable changes and modifications can be made to the embodiments of the present invention described above to make other embodiments, these changes and modifications are within the scope of the present invention, and the following descriptions are merely examples in preferable embodiments of the present invention and are not limiting.

The toner of the present disclosure contains a binder resin containing one or more kinds of crystalline resin and one or more kinds of non-crystalline resin. The non-crystalline resin located at the surface portion of the toner forms a shell structure of a continuous phase of the non-crystalline resin. Also, the toner has an amount of melting heat of 30 J/g or more in a second temperature rising as measured by differential scanning calorimetry (DSC).

Such a shell structure is formed by phase separation of the non-crystalline resin dissolved in a solvent. During this phase separation, the non-crystalline resin comes to be locally present around the surface of the toner, forming a uniform and continuous phase shell layer. That is, unlike a conventional shell layer formed by particulates of a non-crystalline resin, this shell layer of the toner of the present disclosure has no interface between the shell and the core.

The toner of the present disclosure contains optional components such as a coloring agent (colorant), a releasing agent, and a charge control agent.

Binder Resin

The binder resin for use in the present disclosure contains a crystalline resin. To demonstrate low temperature fixability and stress resistance at high levels, the crystalline resin accounts of 50% by weight or more and more preferably 65% by weight or more.

The crystallinity of the crystalline resin in the present disclosure represents a characteristic which drastically softens by heat, with a ratio {softening temperature to the maximum peak temperature of the melting heat)} of the softening temperature measured by an elevated flow tester to the maximum peak temperature measured by a differential scanning calorimeter (DSC) of preferably from 0.80 to 1.55. A resin having this characteristic is defined as the crystalline resin.

In addition, the non-crystallinity in the present disclosure represents a characteristic which slowly softens by heat, with a ratio (softening temperature to the maximum peak temperature of the melting heat) of the softening temperature measured by an elevated flow tester to the maximum peak temperature measured by a differential scanning calorimeter of greater than 1.55. A resin having this characteristic is defined as the non-crystalline resin.

The softening temperature of the resin and the toner can be measured by a flow tester (e.g., CFT-500D, manufactured by SHIMADZU CORPORATION) as follows: A load of 30 kg/cm$^2$ is applied to one gram of a sample resin by a plunger while heating the sample resin at a temperature rising speed of 3° C./min. to extrude it from a nozzle having a diameter of 0.5 mm and a length of 1 mm; The plunger descending amounts of the flow tester against the temperature is plotted; and the temperature at which a half of the sample has flown out is determined as the softening temperature.

The maximum peak temperature of the melting heat of the resin and the toner can be measured by a differential scanning calorimeter (DSC) (for example, TA-60W and DSC-60, manufactured by SHIMADZU CORPORATION) as follows: As preliminary treatment, the sample supplied to the measurement of the maximum peak temperature of the melting heat is melted at 130° C. followed by cooling down from 130° C. to 70° C. at a temperature falling speed of 1.0° C./min. followed by cooling down from 70° C. to 10° C. at a temperature falling speed of 0.5° C./min. The sample is heated by a DSC at a temperature rising speed of 20° C./min. once to measure the change of absorption and generation of heat; and a graph of "amount of absorption and generation of heat" and "temperature" is drawn; the endothermic peak temperature observed between 20° C. to 100° C. is defined as "Ta*"; If there are multiple endothermic peaks, the temperature at which the amount of endotherm is the largest is determined as Ta*; Thereafter, the sample is preserved at (Ta*—10° C. for six hours and thereafter at (Ta*—15° C. for another six hours; Then, the sample is cooled down by DSC to 0° C. at a temperature falling speed of 10° C./min. followed by heating to at a temperature rising speed of 20° C./min. to measure the change of absorption and generation of heat; a graph as described above is drawn; the temperature corresponding to the maximum peak of the amount of absorption and generation of heat is defined as the maximum peak temperature of the melting heat.

In addition, the amount of melting heat is calculated by the area (peak area) between the temperature at which absorption of heat starts and the temperature at which absorption of heat ends.

Crystalline Resin

The toner of the present disclosure contains one or more kinds of crystalline resin. These crystalline resins are different with regard to, the kind of monomer, molecular weight, acid value, etc.

To improve the property of highest fixing temperature, it is suitable to use a combination of two kinds of crystalline resins having a small molecular weight and a large molecular weight.

Furthermore, it is preferable to use a crystalline resin having a urethane bond and/or a urea bond at its main chain to harden the crystalline resin itself.

Specific examples of the crystalline resin having a urethane bond and/or a urea bond at its main chain include, but are not limited to, a urethane-modified polyester resin, a urea-modified polyester resin, a polyurethane resin, and a polyurea resin. Of these, a urethane-modified polyester resin and a urea-modified polyester resin are preferable because they maintain crystallinity as resin and has a high hardness simultaneously.

Urethane-Modified Crystalline Polyester Resin

The urethane-modified polyester resin can be obtained by, for example, reaction between a crystalline polyester resin and a di- or higher isocyanate compound or reaction between a polyester resin having an isocyanate group at its end and a polyol component.

Specific examples of the polyester resin include, but are not limited to, polycondensed polyester resins synthesized by polycondensation of a diol component and a carboxylic acid component, lactone ring opening polymers, and polyhydroxycarboxylic acid. Of these, the polycondensed polyester resins synthesized by polycondensation of a diol and a carboxylic acid are preferable in terms of demonstration of the crystallinity.

Diol Component

As the diol component, aliphatic diols are preferable and the number of carbon atoms in the chain is preferably from 2 to 36. The aliphatic diols are classified into a straight chain type and a branch-chain type. The straight-chain type aliphatic diols are preferable and the straight-chain type aliphatic diols having four to six carbon atoms are more preferable. As the diol component, multiple diol components can be used. The content of the straight-chain type aliphatic diols is preferably 80% by mol or higher and more preferably 90% by mol or higher based on the total content of the diol component.

The content within this range is preferable because the crystallinity of the resin is improved, the combination of low temperature fixability and high temperature storage is good, and the hardness is improved.

Specific examples of the straight-chain type aliphatic diols include, but are not limited to, ethylene glycol, 1,3-propane diol, 1,4-butane diol, 1,5-pentane diol, 1,6-hexane diol, 1,7 heptane diol, 1,8-octane diol, 1,9-nonane diol, 1,10-decane diol, 1,11-undecane diol, 1,12-dodecane diol, 1,13-tridecane diol, 1,14-tetradecane diol, 1,15-pentadecane diol, 1,16-hexane decane diol, 1,17-heptadecane diol, 1,18-octadecane diol, and 1,20-eicosane diol. Among these, considering the availability, ethylene glycol, 1,3-propane diol, 1,4-butane diol, 1,6-hexane diol, 1,9-nonane diol, and 1,10-decane diol are preferable and 1,4-butane diol and 1,6-hexane diol are more preferable.

Specific examples of optional diols include, but are not limited to, aliphatic diols having 2 to 36 carbon atoms other than the specified above (e.g., 1,2-propylene glycol, 1,3-butane diol, hexane diol, octane diol, decane diol, dodecane diol, tetradecane diol, neopentyl glycol, and 2,2-diethyl-1,3-propane diol); alkylene ether glycols having 4 to 36 carbon atoms (e.g., diethylene glycol, triethylene glycol, dipropylene glycol, polyethylene glycol, polypropylene glycol, and polytetramethylene ether glycol); alicyclic diols having 4 to 36 carbon atoms (e.g., 1,4-cyclohexane dimethanol and hydrogenated bisphenol); Adducts of the alicyclic diols specified above with 1 mol to 30 mols of alkylene oxide (hereinafter referred to as AO) such as ethylene oxide (hereinafter referred to as EO), propylene oxide (hereinafter referred to as PO), and butylene oxide (hereinafter referred to as BO); adducts of bisphenols (e.g., bisphenol A, bisphenol F, and bisphenol S) with 2 mols to 30 mols of AO (EO, PO, BO, etc.); polylactone diols (e.g., poly$\epsilon$-caprolactone diol); and polybutadiene diol).

Specific examples of the optional tri- or higher alcohol components include, but are not limited to, tri- or higher aliphatic polyols having 3 to 36 carbon atoms (e.g., alkane polyools and inner or inter molecular dehydrated compounds thereof, e.g., glycerine, trimethylol ethane, trimethylol propane, pentaerythritol, sorbitol, sorbitane, and polyglycerine); Sugars and derivatives thereof (e.g., sucrose and methyl glucoside); adducts of trisphenols (e.g., triphenol PA) with 2 mols to 30 mols of AO; adducts of novolac resins (e.g., phenolic novolac and cresol novolac) with 2 mols to 30 mols of AO; and copolymers of acrylic polyol (e.g., copolymers of hydroxyethyl(meth)acrylate and another vinyl-based monomer). Among these, tri- or higher aliphatic polyols and adducts of novolac resins with AO are preferable and adducts of novolac resins with AO are more preferable.

Dicarboxylic Acid Component

Preferred specific examples of the carboxylic acid components include, but are not limited to, aliphatic dicarboxylic acids and aromatic dicarboxylic acids. The aliphatic dicarboxylic acids are classified into the straight chain type and the branch-chained type. The straight chain type dicarboxylic acids are more preferable. Of these straight chain type dicarboxylic acids, saturated aliphatic dicarboxylic acids having from 6 to 12 carbon atoms are particularly preferable.

Specific examples of the dicarboxylic acid include, but are not limited to, alkane dicarboxylic acids having 4 to 36 carbon atoms such as succinic acid, adipic acid, azelaic acid, sebacic acid, dodecane dicarboxylic acid, tetradecane dicarboxylic acid, hexadecane dicarboxylic acid, and octadecane dicarboxylic acid; alicyclic dicarboxylic acids having 6 to 40 carbon atoms such as dimer acid (dimerized linolic acid); alkene dicarboxylic acids having 4 to 36 carbon atoms such as alkenyl succinic acids such as dodecenyl succinic acid, pentadecenyl succinic acid, and octadecenyl succinic, maleic acid, fumaric acid, and citraconic acid; and aromatic dicarboxylic acids having 8 to 36 carbon atoms such as phthalic acid, isophthalic acid, terephthalic acid, t-butyl isophthalic acid, 2,6-naphthalene dicarboxylic acid, and 4,4'-biphenyl dicarboxylic acid).

Specific examples of the optional polycarboxylic acids having three or more hydroxyl groups include, but are not limited to, aromatic polycarboxylic acids having 9 to 20 carbon atoms (e.g., trimellitic acid and pyromellitic acid).

As the dicarboxylic acid or polycarboxylic acids having three or more hydroxyl groups, anhydrides or lower alkyl esters (e.g., methyl esters, ethyl esters, or isopropyl esters) having one to four carbon atoms can be used.

Among these dicarboxylic acids, it is preferable to use the aliphatic dicarboxylic acids (preferably adipic acid, sebacic acid, and dodecane dicarboxylic acid) singly or in combination. Copolymers of the aliphatic dicarboxylic acids and the aromatic dicarboxylic acids (preferably isophthalic acid, terephthalic acid, t-butyl isophthalic acid, and lower alkyl esters thereof) are also preferable. The amount of copolymerized aromatic dicarboxylic acid is preferably 20% by mol or less.

Lactone Ring-Opening Polymer

The lactone ring-opening polymers as the polyester resin can be obtained by, for example, ring-opening polymerizing a lactone such as a monolactone (the number of ester groups is one in the ring) having 3 to 12 carbon atoms such as $\beta$-propio lactone, $\gamma$-butylo lactone, $\delta$-valero lactone, and $\epsilon$-capro lactone using a catalyst such as a metal oxide and an organic metal compound. Among these, $\epsilon$-capro lactone is preferable in terms of crystallinity.

In addition, lactone ring-opening polymers having a hydroxyl group at their end obtained by ring-opening polymerizing the lactones specified above using a glycol (e.g., ethylene glycol and diethylene glycol) as an initiator are suitable. Also the end can be modified to be a carboxyl group. Products available from the market can be also used. These are, for example, high-crystalline polycapro lactones such as PLACCEL series H1P, H4, H5, and H7 (manufactured by DAICEL CORPORATION).

Polyhydroxy Carboxylic Acid

Polyhydroxy carboxylic acids as the polyester resins are obtained by direct dehydrocondensation of hydroxycarboxylic acid such as a glycolic acid, lactic acid (L-, D- and meso form). However, it is preferable to obtain them by ring-opening a cyclic ester (the number of ester groups in the ring is two or three) having 4 to 12 carbon atoms corresponding to an inter two or three molecule dehydrocondensed compound of a hydroxycarboxylic acid such as glycolide and lactide (L-, D- and meso form) with a catalyst such as a metal oxide and an organic metal compound in terms of controlling the molecular weight. Among these, preferable cyclic esters are L-lactide and D-lactide in light of crystallinity. In addition, these polyhydrocarboxylic acids that are modified to have a hydroxy group or a carboxyli group at the end are also suitable.

Di- or Higher Isocyanate Component

Specific examples of the isocyaante compounds include, but are not limited to, aromatic isocyanates, aliphatic isocyanates, alicyclic isocyanates, and aromatic aliphatic isocyanates (among these, for example, aromatic diisocyanates having 6 to 20 carbon atoms, aliphatic diisocyanates having 2 to 18 carbon atoms, alicyclic diisocyanates having 4 to 15 carbon atoms, aromatic aliphatic diisocyanates having 8 to 15 carbon atoms, modified diisocyanates thereof (modified compounds having a urethane group, a cabodiimide group, an allophanate group, a urea group, a biuret group, a uretdione group, a uretimine group, an isocyanulate group, and an oxazoline group), and mixtures thereof, in which the number of carbon atoms specified above excludes the number of carbon atoms in NCO group).

Optionally, tri- or higher isocynates can be used in combination therewith.

Specific examples of the aromatic isocyanates include 1,3- and/or 1,4-phenylene diisocyanate, 2,4- and/or 2,6-tolylene diisocyanate (TDI), crude TDI, 2,4'- and/or 4,4'-diphenyl methane diisocyanate (MDI), crude MDI (phosgenized compound of crude diamino diphenyl methane (condensed products of formaldehyde and aromatic amine (aniline) or its mixture; mixtures of diamino diphenyl methane with a small quantity (e.g., 5% by weight to 20% by weight) of tri- or higher polyamines), polyaryl polyisocyanate (PAPI), 1,5-naphthylene diisocyanate, 4,4'4"-triphenyl methane triisocyanate, and m- or p-isocyanato phenyl sulfonyl isocyanate.

Specific examples of the aliphatic isocyanates include, but are not limited to, ethylene diisocyanate, tetramethylene diisocyanate, hexamethylene diisocyanate (HDI), dodecamethylene diisocyanate, 1,6,11-undecane triisocyanate, 2,2,4-trimethyl hexamethylene diisocyanate, lysine diisocyanate, 2,6-diisocyanato methyl caproate, bis(2-isocyanato ethyl) fumarate, bis(2-isocyanato ethyl) carbonate, and 2-isocyanatoethyl-2,6-diisocyanato hexanoate.

Specific examples of the alicyclic isocyanates include, but are not limited to, isophorone diisocyanate (IPDI), dicyclo hexyl methane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, 2,5- and/or 2,6-norbornane diisocyanate.

Specific examples of the aromatic aliphatic diisocyanates include, but are not limited to, m- and/or p-xylylene diisocyanate (XDI), α,α,α',α'-tetramethyl xylylene diisocyanate (TMIXDI).

Specific examples of the modified compounds of the diisocyanates include, but are not limited to, modified compounds having a urethane group, a cabodiimide group, an allophanate group, a urea group, a biuret group, a uretdione group, a uretimine group, an isocyanulate group, and an oxazoline group. To be specific, these are: modified MDI such as urethane modified MDI, carbodiimide modified MDI, and trihydrocarbyl phosphate modified MDI), modified compounds of diisocyanates such as urethane modified TDI, and mixtures thereof such as modified MDI and urethane modified TDI (prepolymer containing isocyanate).

Of these, aromatic diisocyanates having 6 to 15 carbon atoms, aliphatic diisocyanates having 4 to 12 carbon atoms, alicyclic diisocyanates having 4 to 15 carbon atoms are preferable, in which the number of carbon atoms excludes the number of carbon atoms in NCO group. Among these, TDI, MDI, HDI, hydrogenated MDI, and IPDI are particularly preferable.

Urea-Modified Crystalline Polyester Resin

It is possible to obtain a urea-modified polyester resin by reacting a polyester resin having an isocyanate group at its end with an amine compound.

Di- or Higher Amine Component

Specific examples of the amine component include, but are not limited to, aliphatic amines and aromatic amines. Of these, aliphatic diamines having 2 to 18 carbon atoms and aromatic diamines having 6 to 20 carbon atoms are suitable. Optionally, tri- or higher amines can be used.

Specific examples of the aliphatic diamines having 2 to 18 carbon atoms include, but are not limited to, alkylene diamines such as ethylene diamine, propylene diamine, trimethylene diamine, tetramethylene diamine, and hexamethylene diamine; polyalkylene diamines having 4 to 18 carbon atoms such as diethylene triamine, iminobis propyl amine, bis(hexamethylene)triamine, triethylene tetramine, tetraethylene pentamine, and pentaethylene hexamine; substituted compounds thereof with an alkyl having 1 to 4 carbon atoms or a hydroxyl alkyl having 2 to 4 carbon atoms such as dialkyl aminopropyl amine, trimethyl hexamethylene diamine, aminoethyl ethanol amine, 2,5-dimethyl-2,5-hexamethylene diamine, and methyl iminobispropyl amine; alicyclic or heterocyclic aliphatic diamines such as alicyclic diamine having 4 to 15 carbon atoms such as 1,3-diamino cyclehexane, isophorone diamine, menthene diamine, 4,4'-methylene dicyclohexane diamine (hydrogenated methylene dianiline and heterocyclic diamine having 4 to 15 carbon atoms such as piperazine, N-aminoethyl piperazine, 1,4-diaminoethyl piperazine, 1,4,-bis(2-amino-2-methylpropyl) piperazine, 3,9-bis(3-aminopropyl)-2,4,8,10-tetraoxaspiro[5,5]undecane; and aromatic aliphatic amines having 8 to 15 carbon atoms such as xylylene diamine, tetrachlor-p-xylylene diamine.

Specific examples of the aromatic diamines having 6 to 20 carbon atoms include, but are not limited to, non-substituted aromatic diamines such as 1,2-, 1,3, or 1,4-phenylene diamine, 2,4,'- or 4,4'-diphenyl methane diamine, crude diphenyl methane diamine (polyphenyl polymethylene polyamine), diaminodiphenyl sulfone, bendidine, thiodianiline, bis(3,4-diaminophenyl) sulfone, 2,6-diaminopilidine, m-aminobenzyl amine, triphenyl methane-4,4',4"-triamine, and naphthylene diamine; aromatic diamines having a nuclear substitution alkyl group having one to four carbon atoms such as 2,4- or 2,6-tolylene diamine, crude tolylene diamine, diethyl tolylene diamine, 4,4'-diamino-3,3'-dimethyldiphenyl methane, 4,4'-bis(o-toluidine), dianisidine, diamino ditolyl sulfone, 1,3-dimethyl-2,4-diaminobenzene, 1,3-dimethyl-2,6-diaminobenzene, 1,4-diisopropyl-2,5-diamino benzene, 2,4-diamino mesitylene, 1-methyl-3,5-diethyl-2,4-diamino benzene, 2,3-dimethyl-1,4-diamino naphthalene, 2,6-dimethyl-1,5-diamino naphthalene, 3,3',5,5'-tetramethyl bendizine, 3,3',5,5'-tetramethyl-4,4'-diamino diphenyl methane, 3,5-diethyl-3'-methyl-2',4-diamino diphenyl methane, 3,3'diethyl-2,2'-diaminodiphenyl methane, 4,4'-diamino-3,3'-dimethyl diphenylmethane, 3,3',5,5'-tetraethyl-4,4'-diaminobenzophenone, 3,3',5,5'-tetraethyl-4,4'-diaminodiphenyl ether, 3,3',5,5'-tetraisopropyl-4,4'-diaminophenyl sulfone; mixtures of isomers thereof with various ratios; aromatic diamines having a nuclear substitution electron withdrawing group (such as halogen (e.g., Cl, Br, I, and F), alkoxy groups such as methoxy group and ethoxy group, and nitro group) such as methylene bis-o-chloroaniline, 4-chlor-o-phenylene diamine, 2-chlor-1,4-phenylene diamine, 3-amino-4-chloroaniline, 4-bromo-1,3-phenylene diamine, 2,5-dichlor-1,4-phenylene diamine, 5-nitro-1,3-phenylene diamine, 3-dimethoxy-4-aminoaniline; 4,4'-diamino-3,3'-dimethyl-5,5'-dibromo-diphenyl methane, 3,3'-dichlorobenzidine, 3,3'dimethoxy benzidine, bis(4-amino-3-chlorophenyl)oxide, bis(4-amino-2-chlorophenyl)propane, bis(4-amino-2-chlorophenyl) sulfone, bis (4-amino-3-methoxyphenyl) decane, bis(4-aminophenyl) sulfide, bis(4-aminophenyl) telluride, bis(4-aminophenyl) selenide, bis(4-amino-3-methoxyphenyl)disulfide, 4,4'-methylene bis(2-iodoaniline), 4,4'-methylene bis(2-bromoaniline), 4,4'-methylene bis(2-fluoroaniline), 4-aminophenyl-2-chloroaniline); aromatic diamines having a secondary amino group such as the non-substituted aromatic diamines specified above, the aromatic diamines having a nuclear substitution alkyl group having one to four carbon atoms, mixtures of isomers thereof with various mixing ratio, compounds in which part or entire of the primary amine group of the aromatic diamines having a nuclear substitution electron withdrawing group specified above is substituted with a lower alkyl group such as methyl group and ethyl group to be a tertiary amino group, 4-4'-di(methylamino)diphenyl methane, and 1-methyl-2-methylamino-4-aminobenzene.

In addition to those, specific examples of the tri- or higher amines include, but are not limited to, polyamide polyamines (low-molecular weight polyamide polyamines obtained by condensation of dicarboxylic acid (e.g., dimeric acid) and excessive (2 mols or more per mol of acid) polyamines (e.g., the alkylene diamines specified above and polyalkylene polyamines specified above) and hydrogenated compounds of cyanoethylated polyether polyamines (e.g., polyether polyols such as polyalkylene glycol).

Polyurethane Resin

Of the polyurethane resins, polyurethane resins synthesized from a diol component and a diisocyanate component are suitably used. Optionally, tri- or higher alcohol components and isocyanate components can be used.

Specific examples of the diol component and the diisocyanate component and the tri- or higher alcohol components and isocyanate components are the same as mentioned above.

Polyurea Resin

Of the polyurea resins, polyurea resins synthesized from a diamine component and a diisocyanate component are suitably used. Optionally, tri- or higher amine components and isocyanate components can be used.

Specific examples of the diamine component and the diisocyanate component and the tri- or higher amine components and isocyanate components are the same as mentioned above.

The maximum peak temperature of the melting heat of the crystalline resin described above is preferably from 45° C. to 70° C., more preferably from 53° C. to 65° C., and particularly preferably from 58° C. to 62° C. in terms of the combination of the low temperature fixability and the high temperature storage. When the maximum peak temperature is too low, the low temperature fixability ameliorates but the high temperature storage tends to deteriorate and the toner and the carrier tend to agglomerate due to stirring stress in the development device, which is not preferable. When the maximum peak temperature is too high, high temperature storage tends to ameliorate but low temperature fixability tends to deteriorate.

The ratio of the softening temperature to the maximum peak temperature of the melting heat of the crystalline resin is preferably from 0.80 to 1.55, more preferably from 0.85 to 1.25, furthermore preferably from 0.90 to 1.20, and particularly preferably from 0.90 to 1.19. A resin with this ratio having a value closer to 1.00 has a characteristic of drastic softening and is excellent in terms of having a good combination of low temperature fixability and high temperature storage.

The weight average molecular weight (Mw) of the crystalline resin A having a smaller molecular weight is preferably from 10,000 to 40,000, more preferably from 15,000 to 35,000, and particularly preferably from 20,000 to 30,000. When the molecular weight is too small, the high temperature storage of toner tends to deteriorate. When the molecular weight is too large, the low temperature fixability of toner tends to deteriorate, which is not preferable.

The weight average molecular weight (Mw) of the crystalline resin B having a larger molecular weight is preferably from 40,000 to 300,000 and particularly preferably from 50,000 to 150,000 in terms of the high temperature storage and the low temperature fixability. When the molecular weight is too small, the hot offset resistance of toner tends to deteriorate. When the molecular weight is too large, the toner tends not to be melted sufficiently at low temperatures during fixing, which leads to peeling-off of the image. That is, the low temperature fixability of the toner tends to deteriorate, which is not preferable.

The difference of Mw between the crystalline resin A and the crystalline resin B is preferably 5,000 or more and more preferably 10,000 or more. When the molecular weight difference is too small, the fixing range of the toner tends to be small, which is not preferable.

The content ratio (A/B) of the crystalline resin A to the crystalline resin B is preferably from 95/5 to 70/30. When the content ratio of A is too large, the hot offset resistance of toner tends to deteriorate and when the content ratio of B is too large, the low temperature fixability of toner tends to deteriorate, which is not preferable.

In the present disclosure, the weight average molecular weight (Mw) of the resin can be measured by using a gel permeation chromatography (GPC) measuring device (for example, GPC-8220 GPC, manufactured by TOSOH CORPORATION) as follows. The column is TSK gel Super HZM-M 15 cm triplet (manufactured by TOSOH CORPORATION).

The resin to be measured is dissolved to obtain a 0.15% by weight solution of tetrahydrofuran (THF) (containing a stabilizer, manufactured by WAKO PURE CHEMICAL INDUSTRIES, LTD.) followed by filtration using a filter having an opening size of 0.2 μm. The resultant filtrate is used as a sample. 100 μl of the THF sample solution is infused into the measuring instrument under the condition that the temperature is 40° C. and the flow speed is 0.35 ml/min. The molecular weight of the sample is calculated based on the relationship between the logarithm value of the standard curve made from several kinds of the mono-dispersed polystyrene standard samples and the count value.

The mono-dispersed polystyrene standard samples are: Showdex STANDARD Std. Nos. S-7300, S-210, S-390, S-875, S-1980, S10.9, S-629, S-3.0, and S-0.580 (manufactured by SHOWA DENKO K.K.) and toluene.

A refractive index (RI) detector is used as the detector.

Block resins that have crystalline portions and non-crystalline portions are suitable as the crystalline resin of the present disclosure. The crystalline resins specified above can be used for the crystalline portions.

As resins for use in forming the non-crystalline portions, specific examples thereof include, but are not limited to, polyester resins, polyurethane resins, and polyurea resins.

The composition of these non-crystalline portions is the same as that of the crystalline portion. Specific examples of the monomer for use include, but are not limited to, the diol components specified above, the dicarboxylic acid components specified above, the diisocyanate components specified above, and the diamine components specified above. Any combination thereof that can form a non-crystalline resin is suitable.

The crystalline resin B can be obtained by polymerization by reaction between a crystalline resin precursor B' having a functional group at its end which is reactive with an active hydrogen group and a resin having an active hydrogen group or a cross-linking agent or an elongation agent having an active hydrogen group in the toner manufacturing process.

The crystalline resin precursor B' is obtained by conducting reaction between the resins mentioned above such as the crystalline polyester resin, the urethane modified crystalline polyester resin, the urea modified crystalline polyester resin, the crystalline polyurethane resin, and the crystalline polyurea resin with a compound having a functional group reactive with an active hydrogen group.

There is no specific limit to the functional group reactive with an active hydrogen group. Specific examples thereof include, but are not limited to, functional groups such as an isocyaante group, an epoxy group, a carboxylic acid group, and an acid chloride group. Among these, an isocyanate group is preferable in terms of the reaction property and the stability.

A specific example of the compound having an isocyanate group is the diisocyanate component described above.

To obtain the crystalline resin precursor B', for example, in a case of the reaction of the crystalline polyester resin mentioned above and the diisocyanate component mentioned above, it is preferable to use a crystalline polyester resin having a hydroxy group at its end as the crystalline polyester resin.

The crystalline polyester resin having a hydroxy group is obtained by reaction conducted at an equivalent ratio of the hydroxy group [OH] to the carboxylic group [COOH] for the ratio of the diol component to the dicarboxylic acid component from 2/1 to 1/1, more preferably from 1.5/1 to 1/1, and particularly from 1.3/1 to 1.02/1.

With regard to the usage amount of the compound having a functional group reactive with an active hydrogen group, for example, in a case of the crystalline resin precursor B' obtained by reacting a crystalline polyester resin having a hydroxy group with a diisocyanate component, the ratio of the diisocyanate component represented by the equivalent ratio {[NCO]/[OH]} of the isocyanate group [NCO] to the hydroxy group [OH] of the crystalline polyester resin having a hydroxy group is preferably from 5/1 to 1/1, more preferably from 4/1 to 1.2/1, and particularly preferably from 2.5/1 to 1.5/1. In a case of the crystalline resin precursor B' having another skeleton and/or terminal group, just the components are different, so that the ratio is the same.

There is no specific limit to the compounds such as the above-specified resin having an active hydrogen group and the above-specified cross-linking agent or elongation agent having an active hydrogen group and any compound having an active hydrogen group is suitably used.

When the above-specified functional group reactive with an active hydrogen group is the isocyanate group, resins having a hydroxy group (alcoholic hydroxy group and phenolic hydroxy group), amino group, carboxylic group, mercapto group, etc. are suitable. Water and amines are particularly suitable in terms of the reaction speed.

There is no specific limitation to the amines. Specific examples thereof include, but are not limited to, phenylene diamine, diethyltoluene diamine, 4,4'-diamino diphenyl methane, 4,4'-diamino-3,3'-dimethyldicyclo hexylmethane, diamine cyclohexane, isophorone diamine, ethylene diamine, tetramethylene diamine, hexamethylene diamine, diethylene triamine, triethylene tetramine, ethanol amine, hydroxyethyl aniline, aminoethyl mercaptan, aminopropyl mercaptan, amino propionic acid, and amino caproic acid.

In addition, ketimine compounds and oxazolidine compounds in which these amino groups are blocked with ketones (acetone, methylethyl ketone, and methylisobutyl ketone) are also suitable.

Non-Crystalline Resin

The toner of the present disclosure contains one or more kinds of non-crystalline resin as binder resin.

The non-crystalline resin to be added to form a shell layer is preferably incompatible with the crystalline resin serving as the main resin of the binder resin. Considering compatibility with a crystalline resin, a styrene-(meth)acrylic resin is preferable.

In addition, the ratio of the non-crystalline resin accounting for a binder resin is preferably from 5% by weight to 30% by weight and more preferably from 10% by weight to 30% by weight.

Furthermore, the glass transition temperature Tg of the non-crystalline resin mentioned above preferably ranges from 55° C. to 80° C. When the glass transition temperature is 55° C. or higher, damage to an image during transfer is reduced. When the glass transition temperature is 80° C. or lower, low temperature fixability is improved.

Other non-crystalline resins that satisfy the condition of the present disclosure can be added to impart other features without a specific limit.

Compatibility between a non-crystalline resin and a crystalline resin can be checked by the following method. In addition, a combination of a crystalline resin and a non-crystalline resin having an SP difference of 0.5 or higher is determined as non-compatible.

Check of Incompatibility

10% by weight of ethyl acetate solution of a crystalline resin and 10% by weight of ethyl acetate solution of a non-crystalline resin are prepared to prepare three kinds of resin solution mixtures of 1 part and 9 parts, 5 parts and 5 parts, and 9 parts and 1 part of the ethyl acetate solution of a crystalline resin and ethyl acetate solution of a non-crystalline resin, respectively. These solutions are applied onto a transparent PET film using a wire bar followed by drying. If all of the three kinds of applied films are cloudy, both resins are determined as incompatible.

In the present disclosure, the glass transition temperature of a non-crystalline resin is measured by the following method.

Measuring Method of Glass Transition Temperature Tg

The glass transition temperature Tg in the present disclosure is measured by, for example, a differential scanning calorimeter (Q-200, manufactured by TA INSTRUMENTS. JAPAN).

Specifically, the glass transition temperature of a sample is measured by the following procedure.

5.0 mg of sample toner is placed in an aluminum sample container. Thereafter, the sample container is placed on a holder unit and the container and the holder unit are set in an electric furnace.

Thereafter, in a nitrogen atmosphere, the holder unit and the container are heated from −80° C. to 150° C. at a temperature rising speed of 10° C./min. Thereafter, the system is cooled down from 150° C. to −80° C. at a temperature falling speed of 10° C./min. and again heated to 150° C. at a temperature rising speed of 10° C./min to measure a DSC curve using a difference scanning calorimeter (Q-2000, manufactured by TA Instruments Inc.).

Using an analysis program installed on Q-200, the DSC curve at the first temperature rising is selected to obtain the glass transition temperature of the sample of the first temperature rising.

Similarly, the DSC curve at the second temperature rising is selected to obtain the glass transition temperature of the sample of the second temperature rising.

The glass transition temperatures of non-crystalline polyester and other components such as a releasing agent represent the glass transition temperatures thereof of the second temperature rising unless otherwise specified.

Styrene-(Meth)Acrylic Resin

There are technologies to render acrylic particulates to be present locally on the surface layer of toner. However, these involve problems such that preparation of particulates having uniform diameter is a prerequisite and the thickness of a shell layer depends on the particle diameter of particulates.

In particular, if a uniform shell layer is demanded, acrylic particles having a sharper particle size distribution are required, which inevitably boosts the cost of toner.

In the present disclosure, as described above, there is no need to use particulates of shell materials. This is advantageous in terms of the cost and designing of the thickness of a shell layer.

As the styrene-(meth)acrylic resin, a copolymer of a styrene-based monomer and a (meth)acrylic monomer is preferable.

Specific examples of the styrene-based monomer include, but are not limited to, styrene, o-methylene styrene, m-methylstyrene, p-methylstyrene, p-phenylstyrene, p-ethylstyrene, 2,4-dimethylstyrene, p-n-amylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, p-nitrostyrene, and derivatives thereof.

Specific examples of the acrylic monomer include, but are not limited to, acrylic acid and esters thereof.

Specific examples of the esters of acrylic acid include, but are not limited to, methyl acrylate, ethyl acrylate, propyl acrylate, n-butyl acrylate, isobutyl acrylate, n-octyl acrylate, n-dodecyl acrylate, 2-ethylhexyl acrylate, stearyl acrylate, 2-chloroethyl acrylate, and phenyl acylate.

Specific examples of the methacrylic monomer include, but are not limited to, methacrylic acid and esters thereof.

Specific examples of the esters of methacrylic acid include, but are not limited to, methyl methacrylate, ethyl methacrylate, propyl methacrylate, n-butyl methacrylate, isobutyl methacrylate, n-octyl methacrylate, n-dodecyl methacrylate, 2-ethylhexyl methacrylate, stearyl methacrylate, phenyl methacylate, dimethyl aminoethyl methacrylate, and diethyl aminoethyl methacrylate.

There is no specific limit to the polymerization initiators for use in manufacturing of the styrene monomer and the (meth)acrylic monomer. Specific examples of such polymerization initiators include, but are not limited to, 2,2'-azobisisobutylo nitrile, 2,2'-azobis(4-methoxy-2,4-dimethyl valero nitrile), 2,2'-azobis(2,4-dimethyl valero nitrile), 2,2'-azobis(2-methylbutylonitrile), dimethyl-2,2'-azobis isobutylate, 1,1'-azobis(1-cyclohexane carbonitrile), 2-(carbamoilazo)isobutylnitrile, 2,2'-azobis(2,4,4-trimethylpentane), 2-phenylazo-2'4'-dimethyl-4'-methoxylvaleronitrile, 2,2'-azobis(2-methylpropane), ketone peroxides such as methylethylketone peroxide, acetylacetone peroxide, and cyclohexanone peroxide; 2,2-bis(tert-butylperoxy)butane, tert-butylhydroperoxide, cumene hydroperoxide, 1,1,3,3-tetramethylbutyl hydroperoxide, di-tert-butyl peroxide, tert-buylcumyl peroxide, α-(tert-butylperoxy)isopropyl benzene, isobutyl peroxide, octanoyl peroxide, decanoyl peroxide, lauloyl peroxide, 3,5,5-trimethyl hexanoyl peroxide, benzoyl peroxide, m-tolyl peroxide, diisopropyl peroxy dicarbonate, bis(2-ethylhexyl)peroxy dicarbonate, di-n-propylperoxy dicarbonate, bis(2-ethoxy ethyl)peroxy carbonate, bis(ethoxyisopropyl)peroxy dicarbonate, bis(3-methyl-3-methoxybutyl)peroxycarbonate, acetyl cyclohexylsulphonyl peroxide, tert-butyl peroxy acetate, tert-butylperoxy isobutylate, tert-butylperoxy-2-ethylhexalate, tert-butyl peroxy laurate, tert-butyloxy benzoate, tert-butyl peroxy isopropyl carbonate, di-tert-butylperoxy isophthalate, tert-butyl peroxy allyl carbonate, isoamyl peroxy-2-ethylhenanoate, di-tert-butylperoxy hexahydroterephthalate, and tert-butylperoxy azelate.

Coloring Agent (Colorant)

There is no specific limit to the coloring agent for use in the toner of the present disclosure and any known coloring agent can be selected to a particular application.

There is no specific limit to the color of the coloring agent for use in the toner of the present disclosure. One or more can be selected from black toner, cyan toner, magenta toner, and yellow toner and various kinds of colors can be obtained by selecting the coloring agents. The color toner is preferable.

Specific examples of the black color toner include, but are not limited to, carbon black (C.I. Pigment Black 7) such as furnace black, lamp black, acetylene black, and channel black, metals such as copper, iron (C.I. Pigment Black 11), and titanium oxides, and organic pigments such as aniline black (C.I. Pigment Black 1).

Specific examples of the pigments for magenta include, but are not limited to, C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 150, 163, 177, 179, 184, 202, 206, 207, 209, 211, 269; C.I. Pigment Violet 19; C.I. Vat Red 1, 2, 10, 13, 15, 23, 29, and 35.

Specific examples of the pigments for magenta include, but are not limited to, C.I. Pigment Blue 2, 3, 15, 15:1, 15:2, 15:3, 15:4, 15:6, 16, 17, 60; C.I. Vat Blue 6; C.I. Acid Blue 45; Copper phthalocyanine pigments in which one to five phthal imidemethyl groups are substituted in the phthalocyanine skeleton; and Green 7 and Green 36.

Specific examples of the pigments for yellow include, but are not limited to, C.I. Pigment Yellow 12, 3, 4, 5, 6, 7, 10, 11, 12, 13, 14, 15, 16, 17, 23, 55, 65, 73, 74, 83, 97, 110, 139, 151, 154, 155, 180; C.I. Vat Yellow 1, 3, and 20; and Orange 36.

The content of the coloring agent in the toner is preferably from 1% by weight to 15% by weight and more preferably from 3% by weight to 10% by weight. When the content of the coloring agent is too small, the coloring performance of the toner tends to deteriorate. To the contrary, when the content of the coloring agent is too great, dispersion of the pigment in the toner tends to be insufficient, thereby degrading the coloring performance and the electric characteristics of the toner.

The coloring agent and the resin can be used in combination as a master batch. There is no specific limit to such resins. In terms of the compatibility with the binder resin in the present disclosure, using the binder resin for use in the present disclosure or resins having a structure similar thereto is preferable.

The master batch can be manufactured by applying a high shearing force to the resin and the coloring agent for mixing and/or kneading. In this case, an organic solvent can be used to boost the interaction between the coloring agent and the resin. In addition, so-called flushing methods are advantageous in that there is no need to drying because a wet cake of the coloring agent can be used as they are. The flushing method is a method in which a water paste containing water of a coloring agent is mixed or kneaded with an organic solvent and the coloring agent is transferred to the resin side to remove water and the organic solvent.

High shearing dispersion devices such as a three-roll mill, etc. can be used for mixing or kneading.

Releasing Agent

There is no specific limit to the releasing agent. Any known releasing agent can be selected to a particular application. Specific examples thereof include, carbonyl group containing waxes, polyolefin waxes, and waxes having a long chain hydrocarbon. These can be used alone or in combination. Of these waxes, the waxes containing a carbonyl group are particularly preferable.

Specific examples of the waxes containing a carbonyl group include, but are not limited to, polyalkane acid esters, polyalkanol esters, polyalkane acid amides, polyalkyl amides, and dialkyl ketones.

Specific examples of the polyalkane acid esters include, but are not limited to, carnauba wax, montan wax, trimethylol propane tribehenate, pentaerythritol tetrabehenate, pentaerythritol diacetate dibehenate, glycerin tribehenate, and 1,18-octadecanediol distearate. Specific examples of the polyalkanol esters include, but are not limited to, trimellitic acid tristearyl and distearyl maleate.

A specific example of the polyalkane acid amide is dibehenyl amide.

A specific example of the polyalkyl amide is trimellitic acid tristearyl amide.

A specific example of the dialkyl ketone is distearyl ketone.

Of these waxes containing a carbonyl group, the polyalkane acid esters are preferably usable.

Specific examples of the polyolefine waxes include, but are not limited to, polyethylene waxes and polypropylene waxes.

Specific examples of the waxes having a long-chain hydrocarbon include, but are not limited to, paraffin wax and sazol wax.

There is no specific limit to the melting point of the releasing agent. The melting point can be determined to a particular application and is preferably from 50° C. to 100° C. and more preferably from 60° C. to 90° C.

When the melting point of the releasing agent is too low, the high temperature stability of toner tends to deteriorate. In contrast, when the melting point is too high, a cold offset, i.e., an offset phenomenon that occurs at low fixing temperatures, tends to occur.

The melting point of the releasing agent can be measured by a differential scanning calorimeter (for example, TA-60WS or DSC-60, manufactured by Shimadzu Corporation).

That is, place 5.0 mg of the releasing agent in an aluminum sample container, set the sample container on a holder unit, and set them in an electric furnace. Next, raise the temperature in nitrogen atmosphere from 0° C. to 150° C. at a temperature rising speed of 10° C./min. Thereafter, drop the temperature from 150° C. to 0° C. at a temperature falling speed of 10° C./min. Then, raise the temperature in nitrogen atmosphere from 0° C. to 150° C. at a temperature rising speed of 10° C./min. again to plot a differential scanning calorimetry (DSC) curve Using an analysis program installed in the DSC-60 system, determine the maximum peak temperature of the melting heat during the second temperature rising as the melting point from the obtained DSC curve.

The releasing agent preferably has a melt viscosity at 100° C. of from 5 mPa·sec to 100 mPa·sec, more preferably from 5 mPa·sec to 50 mPa·sec, and particularly preferably from 5 mPa·sec to 20 mPa·sec. When the melt viscosity is too small, the releasability tends to deteriorate. When the melt viscosity is too large, the dispersability of the releasing agent in the toner tends to deteriorate, thereby degrading hot offset resistance and releasability at low temperatures, which is not preferable.

There is no specific limit to the content of the releasing agent in the toner. For example, the content is preferably from 1% by weight to 20% by weight and more preferably from 3% by weight to 10% by weight.

When the content is too small, the hot offset resistance tends to deteriorate and when the content is too large, the high temperature storage, the chargeability, the transferability, and the stress-resistance tend to deteriorate, which is not preferable.

Charge Control Agent

It is preferable to use a negatively-charged charge control agent containing a polycondensation element obtained from polycondensation reaction between a phenolic compound and an aldehyde for the toner of the present disclosure.

Metal complexes, which are widely used as charge control agents, is never or little soluble in organic solvents.

In contrast, polycondensation element obtained from polycondensation reaction between a phenolic compound and an aldehyde is suitable because it is soluble in an organic solvent.

The phenolic compound has a single phenolic hydroxy group. Specific examples thereof include, but are not limited to, phenolic compounds having a hydrogen atom at its ortho position such as p-alkyl phenols, p-aralkyl phenols, p-phenyl phenols, and p-hydrosy benzoates. Specific examples of the aldehydes include, but are not limited to, paraformaldehyde, formaldehyde, paraldehyde, and furfural.

A specific example of the charge control agent available on the market is a charge control agent (manufactured by FUJIKURAKASEI CO., LTD.) containing a condensed polymer of FCA-N type.

The method of conducting reaction between a phenolic compound and a aldehyde is, for example, adding a phenolic compound and an aldehyde to an organic solvent such as xylene, conducting polycondensation reaction under presence of a strong base such as an alkali metal or alkali earth metal for 3 to 20 hours while distilling away water at 80° C. to the melting point of the solvent and preferably 100° C. to the melting point of the solvent, and thereafter conducting recrystallization using a poor solvent such as alcohol or drying up the organic solvent with a reduced pressure followed by washing with alcohol such as methanol, ethanol, and isopropanol.

Specific examples of the strong base include, but are not limited to, sodium hydroxide, rubidium hydroxide, and potassium hydroxide.

A polycondensed element obtained by the polycondensation reaction between a phenolic compound and an aldehyde contributes to improvement of chargeability and formation of particles having irregular forms by adding 0.1 parts by weight to 5 parts by weight based on 100 parts of a toner composition.

When the content is too large, the fixability of toner tends to deteriorate.

Known charge control agent can be optionally used in combination.

Specific examples of the charge controlling agent include, but are not limited to, Nigrosine dyes, triphenylmethane dyes, metal complex dyes including chromium, chelate compounds of molybdic acid, Rhodamine dyes, alkoxyamines, quaternary ammonium salts, alkylamides, phosphorous element and compounds, tungsten element and compounds, fluorine-containing activators, metal salts of salicylic acid, metal salts of salicylic acid derivatives, etc. Specific examples of the marketed products of the charge controlling agents include, but are not limited to, BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

External Additive

It is possible to add external additives to reform the fluidity and adjust the size of charge and the electric characteristics to the toner of the present disclosure.

There is no specific limit to the external additives and any known external additives is suitably used to a particular application. Specific examples thereof include, but are not limited to, silica particulates, hydrophpobized silica particulates, aliphatic acid metal salts (such as zinc stearate and aluminum stearate); metal oxides (such as titania, alumina, tin oxide, antimony oxide) and hydrophobized compounds thereof, and fluoropolymers.

Of these, hydrorphobized silica particulates, titania particles, and hydrophobized titania particulates are preferable.

Specific examples of the hydrophobized silica particles include, but are not limited to, HDK H 2000, HDK H 2000/4, HDK H 2050 EP, HVK21, HDK H 1303, (all manufactured by HOECHST AG), R972, R974, RX200, RY200, R202, R805, and R812 (manufactured by NIPPON AEROSIL CO., LTD.). In addition, specific examples of the titania particulates include, but are not limited to, P-25 (manufactured by NIPPON AEROSIL CO., LTD.), STT-30 and STT-65C-S (manufactured by TITAN KOGYO, LTD.), TAF-140 (manufactured by FUJI TITANIUM INDUSTRY CO., LTD.), and MT-150W, MT-500B, MT-600B, and MT-150A (manufactured by TAYCA CORPORATION). Specific examples of the hydrophobized titan oxide particulates include, but are not limited to, T-805 (manufactured by NIPPON AEROSIL CO., LTD.); STT-30A and STT-65S-S (manufactured by TITAN KOGYO, LTD.); TAF-500T and TAF-1500T (manufactured by FUJI TITANIUM INDUSTRY CO., LTD.); MT-100S and MT-100T (manufactured by TAYCA CORPORATION); and IT-S (manufactured by ISHIHARA SANGYO KAISHA LTD.).

The hydrophobized silica particulates, the hydrophobized titania particulates, and the hydrophobized alumina particulates can be obtained by treating hydrophillic particulates with a silane coupling agent such as methyl trimethoxyxilane, methyltriethoxy silane, and octyl trimethoxysilane.

Specific examples of hydrophobizing agents include, but are not limited to, silane coupling agents such as dialkyl dihalogenated silane, trialkyl halogenized silane, alkyl trihalogenized silane, and hexa alkyl disilazane; silylating agents, silane coupling agents having an alkyl fluoride group, organic titanate coupling agents, aluminum-containing coupling agents, silicone oil, and silicone varnish.

The inorganic particulate preferably has an average primary particle diameter of from 1 nm to 100 nm and more preferably from 3 nm to 70 nm. When the average particle diameter is too small, the organic particulates are buried in the toner, so that its features are not suitably demonstrated. When the average particle diameter is too large, the surface of the image bearing member may be damaged unevenly. Inorganic particulates and hydrophobized inorganic particulates can be used in combination as the external additives. It is more preferable that the external additives contain two or more kinds of inorganic particulates having an average primary particle diameter of 20 nm or less and one or more kinds of inorganic particulates having an average primary particle diameter of 30 nm or more. In addition, the specific surface area of such inorganic particulates as measured by the BET method is preferably from 20 $m^2/g$ to 500 $m^2/g$.

The content of the external additive is preferably from 0.1% by weight to 5% by weight and more preferably from 0.3% by weight to 3% by weight based on the toner.

Resin particulates can be added as the external additives. Specific examples thereof include, but are not limited to, polystyrene prepared by a soap-free emulsion polymerization method, a suspension polymerization method, or a dispersion polymerization method; and copolymers of methacrylic acid esters and acrylic acid esters; polycondensation resins such as silicone resins, benzoguanamine resins, and nylon resins, and polymerized particles by a thermocuring resin. By a combinational use of such resin particulates, the chargeability of the toner is improved, thereby reducing the reversely charged toner, resulting in a decrease in background fouling.

The content of the resin particulates is preferably from 0.01% by weight to 5% by weight and more preferably from 0.1% by weight to 2% by weight, based on the toner.

The toner of the present disclosure contains nitrogen element of preferably from 0.3% by weight to 2.0% by weight, more preferably from 0.5% by weight to 1.8% by weight, and furthermore preferably from 0.7% by weight to 1.6% by weight as measured by CHN analysis for portions soluble in THF. When the content of nitrogen element is too large, the viscoelasticity of melted toner is increased excessively, which may have an adverse impact on fixability, gloss, and chargeability. When the content of nitrogen element is too small, the toughness of toner is easily lost, which leads to agglomeration of toner or contamination thereof in an image forming apparatus and occurrence of hot offset due to decrease of the viscoelasticity of melted toner.

The content of nitrogen element is measured by vario MICRO cube (produced by Elementar) at 950° C. (burner reactor) and 550° C. (reduction furnace) with a flowing amount of helium of 200 ml/min and a flowing amount of oxygen of from 25 ml/min to 30 ml/min for CHN simultaneous measuring. This measuring is conducted twice and the average of the two measuring results is determined as the content of nitrogen element. When the content of the nitrogen element is 0.5% by weight or less, the content of nitrogen element is measured by a minute amount of nitrogen analyzer (model ND-100, Mitsubishi Chemical Corporation).

The measuring conditions are as follows:

Furnace temperature (horizontal type reactor): 800° C. at heat decomposition portion; 900° C. at catalyst portion Flowing amount of main $O_2$: 300 ml/min Flowing amount of $O_2$: 300 ml/min Flowing amount of Ar: 400 ml/min Sensitivity: Low Quantification is conducted based on a standard curve obtained by a pyridine standard liquid.

The portion soluble of toner in THF is obtained by: preliminarily placing 5 g of toner in soxhlet extractor followed by conducting 20 hour extraction by 70 ml of THF; and removing THF from the extracted resultant by heating and reduced pressure.

The toner of the present disclosure preferably has a melting heat of 30 J/g as measured in the second temperature rising according to the DSC described above to have excellent low temperature fixability.

In addition, when the amount of melting heat of toner is 30 J/g or more, the amount of the portions having crystalline structures in the toner tends to be increased so that the sharp melting property of the toner is ameliorated, resulting in a good balance between high temperature stability and low temperature fixability. The amount of melting heat is preferably from 40 J/g or more and more preferably 50 J/g or more. There is of specific limit to the upper limit of the melting heat. When the amount of the melting heat is 75 J/g or less, toner can be melted and fixed with a less amount of energy, thereby ameliorating the fixability of toner.

When the maximum peak temperature of the melting heat in the temperature rising for the second time as measured by DSC is 50° C. or higher, blocking of toner does not easily occur. When the maximum peak temperature is 70° C. or higher, the low temperature fixability is easily demonstrated. The maximum peak temperature is preferably from 55° C. to 68° C. and particularly from 58° C. to 65° C.

The toner of the present disclosure can be manufactured by discharging a toner Composition Liquid containing a toner composition containing at least the binder resin described above through a piercing hole to obtain droplets.

When forming droplets by discharging a toner Composition Liquid containing a toner composition containing a crystalline resin and a non-crystalline resin (styrene/acrylic resin) more hydrophobic than the crystalline resin into an air phase through a piercing hole, the non-crystalline resin (styrene/acrylic resin) as the hydrophobic component gathers to the interface between the air phase and the liquid phase to form a shell layer.

An example of a toner production device to manufacture the toner of the present disclosure is described with reference to FIGS. 1 to 10. The toner production device to manufacture the toner of the present disclosure is separated into a droplet ejecting device and a droplet solidifying and collecting device.

The toner Composition Liquid for use in the present disclosure is described below. The toner Composition Liquid is in a liquid state in which the toner component mentioned above is dissolved or dispersed in a solvent. This state includes a case in which part or the entire of the toner component is melted and mixed without a solution if it can be discharged or ejected at specified conditions.

Toner materials for electrophotography can be used if they can form the toner Composition Liquid mentioned above. The toner Composition Liquid is formed into microdroplets by the droplet ejecting device and changed into target toner particles by the droplet solidifying and collecting device (hereinafter referred to as droplet solidifying and collecting device).

Organic Solvent

It is preferable to use an organic solvent that dissolves a crystalline resin perfectly at high temperatures to form a uniform solution and simultaneously is phase-separated from the crystalline resin when cooled down to form a non-uniform solution. In other words, the organic solvent is a solution in which a crystalline resin is perfectly dissolved at high temperatures and a solid liquid mixture in which at least part of the crystalline resin is precipitated at low temperatures.

Specific examples thereof include, but are not limited to, toluene, ethyl acetate, butyl acetate, methylethylketone, methyisobutyl ketone, and combinations thereof.

Droplet Ejecting Device

The droplet ejecting device is not particularly limited, and any known droplet ejecting devices can be used as long as the devices can eject droplets having a relatively narrow particle diameter distribution. Specific examples of such droplet ejecting devices include one-fluid nozzle type ejecting devices, two-fluid nozzle type ejecting devices, membrane oscillation type ejecting devices, Rayleigh fission type ejecting devices, and liquid vibration type ejecting devices, and liquid column resonance devices. For example, JP-2008-292976-A discloses membrane oscillation type ejecting devices, JP-4647506-B1 (JP-2007-199463-A) discloses the Rayleigh fission type ejecting devices, and JP-2010-102195-A discloses a liquid vibration type ejecting device.

Liquid column resonance methods have advantages such that ejected droplets have relatively narrow particle diameter distribution; and the methods have good particle productivity. In the liquid column resonance methods, vibration is applied to a liquid in a liquid column resonance chamber, in which multiple ejection nozzles are formed to enhance the productivity of the product (i.e., toner in this case), to form a liquid column resonance standing wave, so that the liquid is ejected from nozzles located in a region in which the standing wave has an antinode, thereby forming droplets of the liquid. It is preferable to use one of the above-mentioned droplet ejecting devices as the droplet ejecting device.

Liquid Column Resonance Type Droplet Ejecting Device

Next, the liquid column resonance type droplet ejecting device is described.

FIG. 1 is a diagram illustrating a liquid column resonance type droplet ejecting device. As illustrated in FIG. 1, a droplet ejecting device 11 includes a common liquid passage 17 and a liquid column resonance chamber 18. The liquid column resonance chamber 18 is communicated with the common liquid passage 17, which is provided on one of walls of the liquid column resonance chamber located at the ends thereof in the longitudinal direction thereof. The liquid column resonance chamber 18 has another wall connected with the longitudinal end walls and having droplet ejection nozzles 19 to eject droplets 21 of a particulate composition liquid, and a vibration generating device 20, which is provided on another wall facing the ejection nozzles 19 and which generates high-frequency vibration to form a liquid column resonance standing wave in the liquid column resonance chamber 18. The vibration generating device 20 is connected with a high-frequency power source.

The liquid to be ejected (discharged) by an ejecting device in the present disclosure is "particulate component containing liquid" in which the component of target particulate is dissolved or dispersed in a solvent or a "melted particulate liquid component" in which particulate components are melted without a solvent if it can be discharged or ejected at specified conditions (hereinafter, referred to as "toner liquid component).

A toner liquid component 14 is fed into the common liquid passage 17 of a liquid column resonance droplet forming unit 10 (illustrated in FIG. 2) by a circulating pump 15 (illustrated in FIG. 9) through a liquid supply passage so that the toner composition liquid 14 is supplied to the liquid column resonance chamber 18. In the liquid column resonance chamber 18 in which the toner composition liquid 14 is contained, pressure distribution is formed due to the liquid column resonance standing wave generated by the vibration generating device 20. Thereafter, the droplets 21 are ejected from the ejection nozzles 19, which are arranged in a region in which the standing wave has an antinode and in which the liquid column resonance standing wave has a large amplitude, and pressure largely fluctuates.

The antinode in this context is all the state except the node.

It is preferable that at the region the standing wave has a large amplitude (i.e., a large pressure fluctuation) sufficient to eject droplets, and it is more preferable that the region is present in a region (hereinafter sometimes referred to as an antinode region) whose center is the maximum amplitude point of the pressure standing wave (i.e., the wave node of the velocity standing wave) and which has a length of ±¼ of the wavelength of the standing wave.

When the multiple droplet ejection nozzles 19 are open in the antinode regions, the multiple droplet ejection nozzles 19 efficiently form and eject droplets having substantially the same particle size with no or little clogging at the nozzles 19.

The toner liquid component 14 passing through the common liquid passage 17 is returned to a raw material container 13 (illustrated in FIG. 9) through a liquid return tube. The amount of the toner liquid component 14 in the liquid column resonance chamber 18 is decreased as the droplets 21 of the toner liquid component 14 are ejected from the nozzles 19.

Accordingly, the force to suck the toner liquid component is increased by the action of the liquid column resonance standing wave in the liquid column resonance chamber 18, thereby increasing the amount of the toner liquid component 14 supplied to the liquid column resonance chamber 18 from the common liquid passage 17, meaning that the liquid column resonance chamber 18 is replenished with the toner liquid component 14.

As a result, the flow rate of the toner liquid component 14 flowing through the common liquid passage 17 is back to the starting flow rate.

The liquid column resonance chamber 18 of the liquid column resonance droplet ejecting device 11 is preferably constituted of connected frames made of a material rigid enough to have no impact on the resonance frequency of the toner liquid component 14 in the liquid column resonance chamber 18, like a metal, ceramics and silicon. In addition, a length L, indicating the distance between two end walls of the liquid column resonance chamber 18 facing in the longitudinal direction as illustrated in FIG. 1, is determined based on the liquid column resonance principle mentioned below. Further, a width W (illustrated in FIG. 2) of the liquid column resonance chamber 18 is preferably less than ½ of the length L in order not to impart an extra frequency to the liquid column resonance.

Furthermore, it is preferable that multiple liquid resonance chambers 18 are provided to a single liquid column resonance droplet forming unit 10 to significantly improve the productivity of the particulate material such as toner. There is no specific limit to the number of the liquid resonance chambers 18. In terms of striking a balance between operability and productivity, a single droplet forming unit 10 most preferably has 100 to 2,000 liquid resonance chambers 18.

Furthermore, a passage is connected with the liquid column resonance chamber 18 to supply liquid from the common liquid passage 17. The common liquid passage 17 is connected with multiple liquid column resonance chambers 18.

Figure 2:
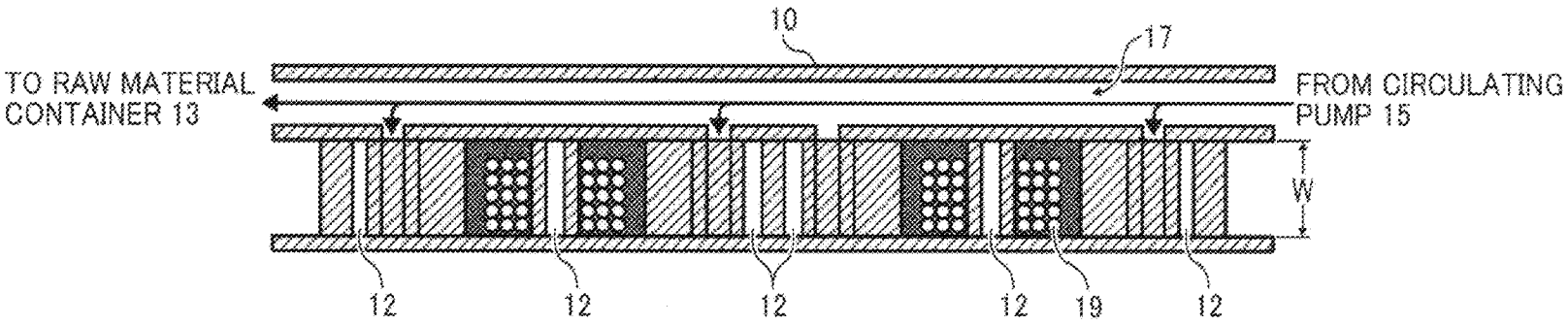
FIG. 2 is a cross section illustrating a liquid column resonance type droplet ejecting unit.

In FIGS. 1 and 2, numeral 12 denotes a gas flow passage.

There is no specific limit to the vibration generating device 20 of the liquid column resonance droplet ejecting device 11 that can be vibrated at a predetermined frequency. It is preferable to use a device having a piezoelectric material attached to an elastic plate 9.

In such a device, the elastic plate 9 constitutes part of the wall of the liquid column resonance chamber 18 so as to prevent the contact between the piezoelectric material and the toner liquid component 14. Piezoelectric ceramics such as lead zirconate titanate (PZT) are used as the piezoelectric material but are generally laminated for practical use because the displacement amount thereof is small. Other specific examples of such piezoelectric materials include, but are not limited to, piezoelectric polymers such as polyvinylidene fluoride (PVDF) and single crystals such as quartz, $LiNbO_3$, $LiTaO_3$, and $KNbO_3$. Further, the vibration generating device 20 is preferably arranged in each liquid column resonance chamber 18 to control vibration of the chamber. In addition, it is preferable that part of a block of the vibration generating device 20 made of one of the materials specified above is cut to arrangement of the liquid column resonance chamber so as to separately control vibration of each liquid column resonance chamber via an elastic plate.

The diameter Dp of each of the ejection nozzles 19 is preferably from 1 μm to 40 μm. When the diameter is less than 1 μm, the diameter of ejected droplets easily becomes too small to obtain toner having a desired particle diameter. In addition, when the toner liquid component includes a solid particulate material such as pigments, nozzle clogging problems easily occur at the droplet ejection nozzles 19, which leads to lower productivity of the particulate material. In contrast, when the diameter is greater than 40 μm, the diameter of ejected droplets becomes too large. To prepare toner particles having a diameter of from 3 μm to 6 μm using such large droplets, the particulate material composition liquid (toner composition liquid) has to have a very low solid content (i.e., the particulate material composition liquid has to be diluted so as to be a thin liquid). As a result, a large amount of energy is used to dry the ejected droplets to obtain a predetermined amount of toner, which is disadvantageous. In addition, as seen in FIG. 2, the droplet ejection nozzles 19 are preferably arranged in the width direction of the liquid column resonance chamber 18 so as to have a number of nozzles, thereby increasing the production efficiency of the particulate material. Since the liquid column resonance frequency changes depending on the position of the ejection nozzles 19, it is preferable to determine the liquid column resonance frequency by checking whether desired droplets are ejected from the ejection nozzles 19.

The ejection nozzle 19 illustrated in FIG. 1 has a cross section with a tapered form (i.e., a trapezoidal form) such that the diameter of the opening of a nozzle decreases toward the exit. The form of the cross-section is not limited thereto.

Figure 3A:
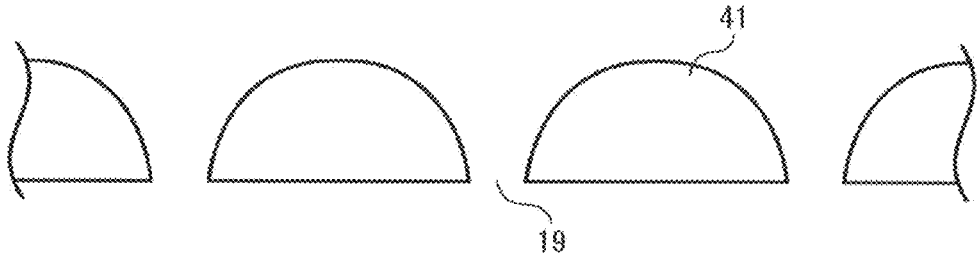
FIGS. 3A to 3D are schematic cross sections illustrating examples of the ejection nozzles of the droplet ejecting device.

FIGS. 3A-3D illustrates other forms of the cross-section of the ejection nozzles 19. The ejection nozzles illustrated in FIG. 3A have a cross-section such that a thin film 41 forming the nozzles 19 has a round surface from an upper surface thereof contacted with the liquid 14 toward the bottom surface thereof forming the nozzle 19 in such a manner that the gap between one thin film and the adjacent thin film (i.e., nozzle) narrows toward the exit. When the thin film 41 is vibrated, the pressure applied to the liquid at the exit of the nozzle 19 is maximized. Therefore, the shape of the nozzles illustrated in FIG. 3A is most preferable to stably eject droplets.

Figure 3B:
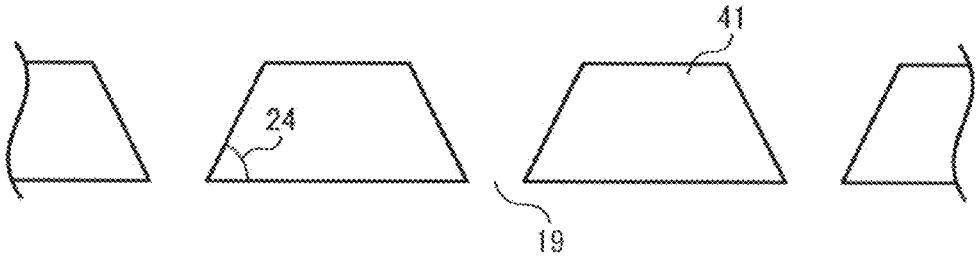

The ejection nozzles illustrated in FIG. 3B have a cross-section such that the thin film 41 forming the nozzles 19 is tapered from an upper surface thereof contacted with the liquid toward the bottom surface thereof forming the nozzles 19 in such a manner that the gap between one thin film and the adjacent thin film narrows toward the exit at a constant rate (namely the surface of the thin film 41 is slanted at a constant angle (i.e., nozzle angle 24)). The nozzle angle 24 can be set to a proper angle. The pressure applied to the liquid at the exit of the nozzles 19 can be increased when the thin film 41 is vibrated because it has a similar angle to that illustrated in FIG. 3A. This nozzle angle 24 is preferably from 60° to 90°.

When the nozzle angle 24 is not less than 60°, a sufficient pressure can be applied to the liquid, and in addition the thin film 41 has good processability (i.e., the thin film 41 can be easily prepared). When the nozzle angle 24 is 90°, the nozzle form is the same as that illustrated in FIG. 3C, in which case, the exit of the nozzle 19 does not easily receive a pressure. Therefore, the nozzle angle 24 is 90° at maximum.

When the nozzle angle 24 is greater than 90°, it is difficult to apply a pressure to the exit of the nozzle 19, thereby seriously destabilizing ejection of droplets.

Figure 3C:
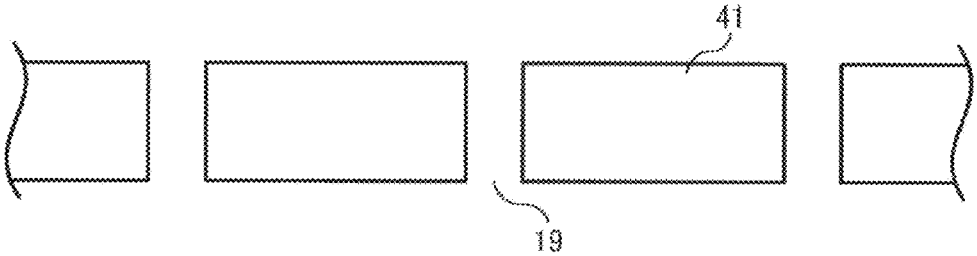
Figure 3D:
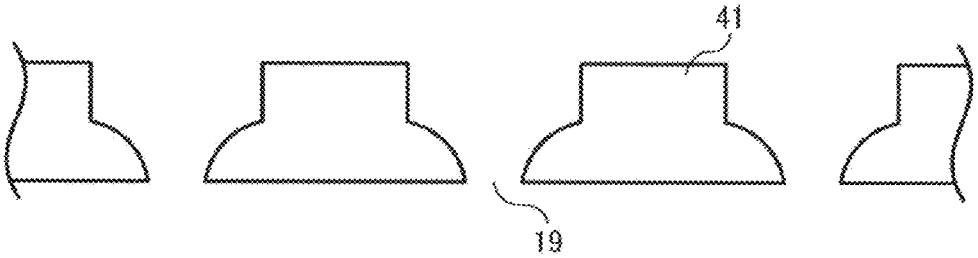

The ejection nozzles illustrated in FIG. 3D have a combinational cross-section of that illustrated in FIG. 3A and that illustrated in FIG. 3C. Such a stepwise change in the form of the nozzle is also allowed.

Next, the mechanism of droplet forming in the liquid column resonance droplet forming unit 10 utilizing liquid column resonance will be described.

Initially, the principle of the liquid column resonance phenomenon caused in the liquid column resonance chamber 18 of the liquid column resonance droplet ejecting device 11 illustrated in FIG. 1 will be described. The wavelength (λ) of resonance of the particulate material liquid component (hereinafter referred to as the toner liquid component) 14 in the liquid column resonance chamber 18 is represented by the following relation 1:

$$\lambda = c/f \qquad \text{Relation 1}$$

where c represents the acoustic velocity in the toner liquid component, and f represents the frequency of vibration applied to the toner liquid component by the vibration generating device 20.

In addition, the most efficient resonance is obtained when satisfying the following relation 2 if both ends are fixed (i.e., closed) and the height h1 (which is about 80 μm) of the end wall on the side of the common liquid passage 17 is about twice the height h2 (which is about 40 μm) of the opening communicating the liquid column resonance chamber 18 with the common liquid passage 17

$$L = (N/4)\lambda \qquad \text{Relation 2}$$

where, as illustrated in FIG. 1, L represents the distance between the end wall on the side of the fixed end and the end wall on the side of the common liquid passage 17 and N is an even number.

Even in a chamber having two open ends, the above-mentioned relation 2 is also satisfied.

Similarly, in a chamber having one end, which has an escape route and which is equivalent to an open end, and one closed end (fixed end), namely, in a chamber having one fixed end or one open end, resonance can be formed most efficiently when the length L is equal to an odd multiple of one fourth of the wavelength λ. Namely, N is an odd number in the above-mentioned relation 2.

The most efficient drive frequency f, at which the resonance can be formed most efficiently, is represented by the following relation 3, which is obtained from the above-mentioned relations 1 and 2:

$$f = N \times c/4L \qquad \text{Relation 3.}$$

However, since liquids have viscosity, which decays resonance, the vibration thereof is not endlessly amplified. Namely, liquids have a Q value, and, as represented by the relations 4 and 5 described below, the resonance thereof occurs at frequencies around the above-mentioned most efficient frequency f represented by the relation 3.

FIGS. 4A-4D illustrate standing waves (in a resonance mode) of velocity fluctuation and pressure fluctuation when N is 1, 2 or 3. FIGS. 5A-5C illustrate standing waves (in a resonance mode) of velocity fluctuation and pressure fluctuation when N is 4 or 5. In reality, the waves are a compression wave (longitudinal wave), but are generally illustrated as such waves as illustrated in FIGS. 4 and 5, rated by a broken line.

In FIGS. 4A to 4D and 5A to 5C, a velocity standing wave is illustrated by a solid line, and a pressure standing wave is illustrated by a dotted line.

Figure 4A:
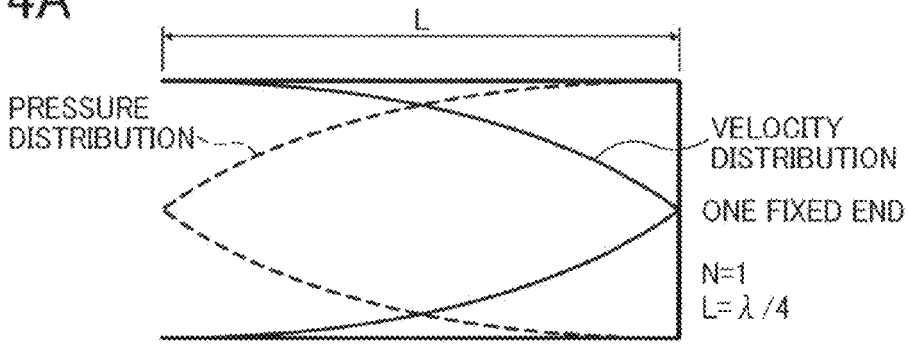
FIGS. 4A to 4D are schematic views illustrating standing waves of velocity fluctuation and pressure fluctuation formed when N=1, 2 or 3.

For example, in a case in which the liquid column resonance chamber has one fixed end and N is 1 as illustrated in FIG. 4A, the frequency of the velocity distribution becomes zero at the closed end while having a maximum value at the open end. This is easily understood intuitively. Provided the length between the ends of the liquid column resonance chamber in the longitudinal direction is L and the wavelength of resonance is λ, the standing wave can be formed most efficiently when N is 1, 2, 3, 4 or 5. Moreover, the form of a standing wave changes depending on whether the end of a liquid column resonance chamber is open or close. Such forms are also included in FIGS. 4A to 4D and 5A to 5C. Whether the end is open or closed depends on the conditions of the openings of the ejection nozzles and the opening from which the liquid 14 is supplied to the chamber 18, which is described later. In acoustics, at an open end, the moving velocity of a medium (liquid) in the longitudinal direction is zero while the pressure is maximized. In contrast, at a closed end, the moving velocity of a medium becomes zero. Namely, a closed end is treated as a hard wall in acoustics, at which a wave is reflected.

Additionally, resonance standing waves as illustrated in FIGS. 4 and 5 are formed when the liquid column resonance chamber has an ideal open end or an ideal closed end. However, the pattern of the standing waves depends on the number and the positions of the ejection nozzles and therefore the most efficient frequency f appears at a slightly shifted position from that obtained from the relation 3. In such a case, stable ejection conditions can be established by adjusting the drive frequency. For example, providing the acoustic velocity c in a liquid used is 1,200 m/s, the length L of the liquid column resonance chamber 18 is 1.85 mm, both the ends are equivalent to closed ends, and the resonance mode is an N=2 resonance mode, the most efficient frequency f is determined as 324 kHz from the above-mentioned relation 3.

In addition, in another case where the acoustic velocity c is 1,200 m/s, the length L of the liquid column resonance chamber is 1.85 mm, both the ends are equivalent to closed ends, and the resonance mode is an N=4 resonance mode, the most efficient frequency f is determined as 648 kHz from relation 3. The structures of the liquid column resonance chambers used in both cases are the same but higher-degree resonance can be used than in the former case.

To increase the most efficient frequency, the liquid column resonance chamber 18 of the liquid column resonance droplet ejecting device 11 illustrated in FIG. 1 preferably has both ends equivalent to closed ends or considered to be acoustically soft walls due to the openings of the nozzles. However, the ends of the liquid column resonance chamber 18 are not limited thereto and open ends are possible. In this context, the openings of the ejection nozzles has an impact in such a manner that the acoustic impedance is decreased and particularly the compliance is increased.

Figure 4B:
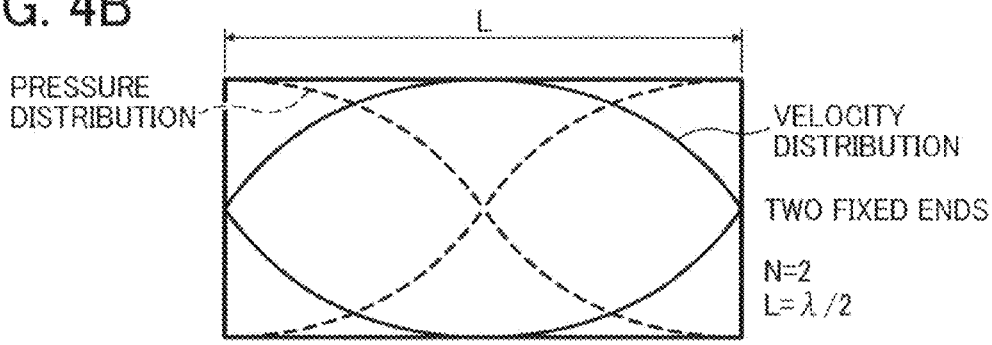
Figure 4C:
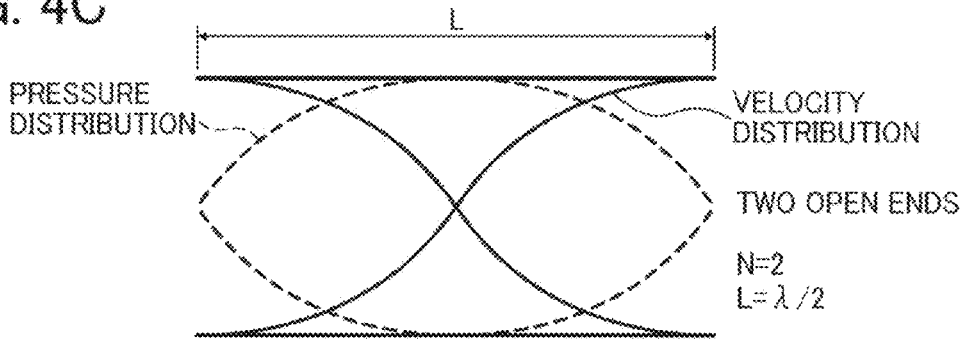
Figure 4D:
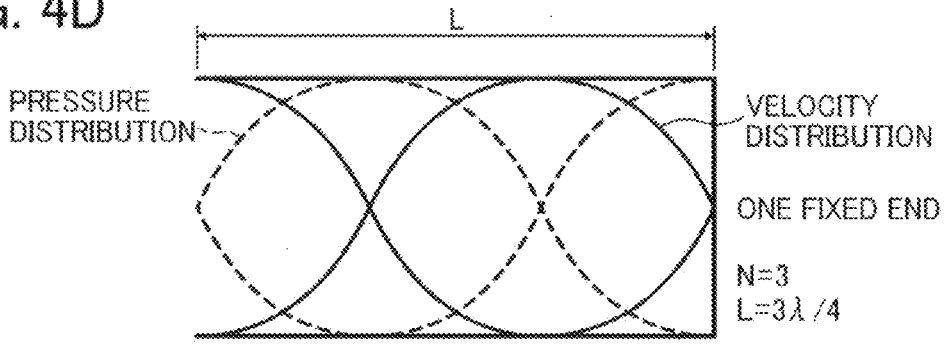
Figure 5A:
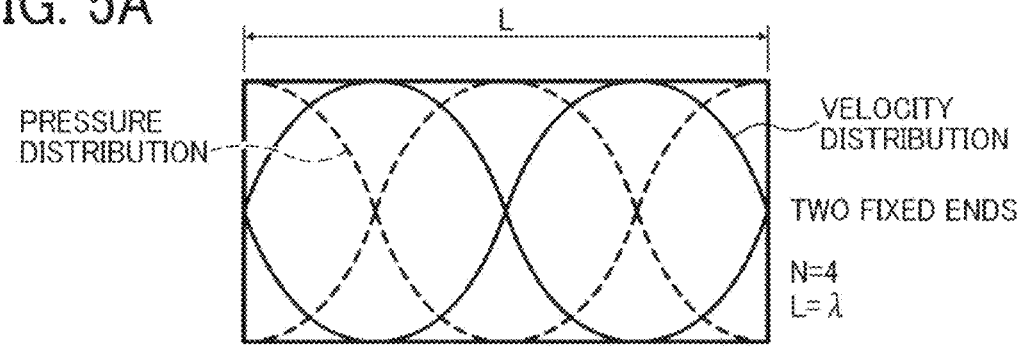
FIGS. 5A to 5C are schematic views illustrating standing waves of velocity fluctuation and pressure fluctuation formed when N=4 or 5.
Figure 5B:
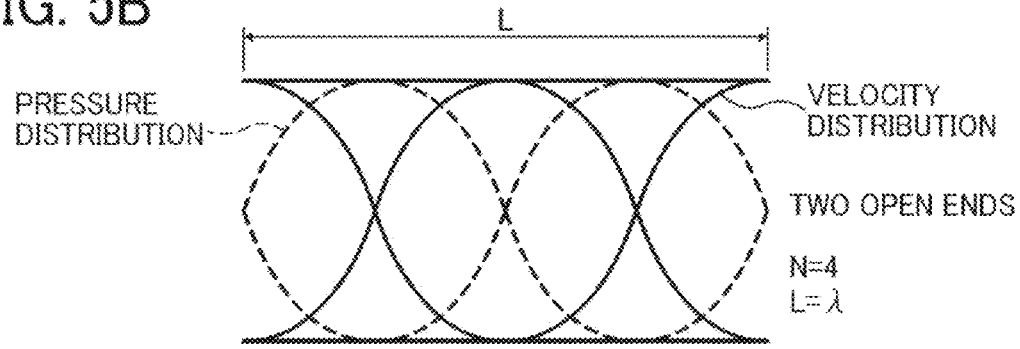
Figure 5C:
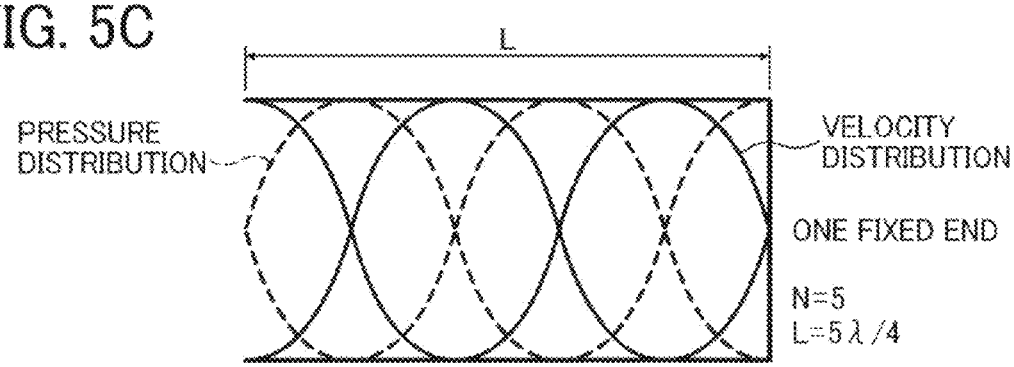

Therefore, the liquid column resonance chamber 18 having a structure as illustrated in FIG. 4B or 5A, in which the walls are formed at both ends of the liquid column resonance chamber in the longitudinal direction, is preferable because it can use all of the resonance modes in the two-closed-end structures and the resonance modes in the one-open-end structures in which the wall on the nozzle side is considered to be an open end.

Also, the number of openings of the ejection nozzles, the positions of the openings, and the cross-section form of the ejection nozzles are factors to determine the drive frequency. The drive frequency is suitably determined according to these factors. For example, when the number of openings of the ejection nozzles is increased, the fixed end of the liquid column resonance chamber becomes loose and similar to an open end, and the generated standing wave is close to a standing wave formed in a chamber having an open end, resulting in increase of the drive frequency. In this case, the wall of the liquid column resonance chamber in the vicinity of the nozzles is loosely restricted, while the opening (nozzle) closest to the common liquid passage 17 serves as an origin. Further, when the ejection nozzles have a round cross-section, or the volume of the nozzles varies depending on the thickness of the frame of the chamber having the nozzles, the real standing wave has a shorter wavelength, and therefore the frequency of the wave becomes higher than the drive frequency.

When a voltage is applied to the vibration generating device at the thus-determined drive frequency, the vibration generating device is deformed and thereby a resonance standing wave can be generated most efficiently at the drive frequency.

In this regard, a resonance standing wave can also be generated at frequencies in the vicinity of the most efficient drive frequency. Namely, providing the length between both ends of the liquid column resonance chamber in the longitudinal direction thereof is L and the length between the end of the chamber closer to the common liquid passage and the nozzle closest to the end is Le, droplets of the toner liquid component 14 can be ejected from the nozzles 19 to liquid column resonance induced by vibration of the vibration generating device caused by a drive wave including, as the main component, a drive frequency f in the range represented by the following relations 4 and 5:

$$N\times c/(4L)\leq f\leq N\times c/(4Le) \quad \text{Relation 4, and}$$

$$N\times c/(4L)\leq f\leq (N+1)\times c/(4Le) \quad \text{Relation 5,}$$

where c represents the velocity of sound wave in the toner liquid component and N represents a positive integer.

The ratio (Le/L) of the length Le between the end of the chamber closer to the common liquid passage and the nozzle closest to the end to the length L between both ends of the liquid column resonance chamber in the longitudinal direction is preferably greater than 0.6.

By utilizing the liquid column resonance phenomenon mentioned above, a liquid column resonance standing wave of pressure is formed in the liquid column resonance chamber 18 illustrated in FIG. 1, thereby continuously ejecting droplets 21 of the toner liquid component 14 from the ejection nozzles 19, which are arranged on a portion of the liquid column resonance chamber 18.

In this regard, it is preferable to arrange the ejection nozzles 19 at a position where the pressure of the standing wave varies most significantly because the droplet ejection efficiency is enhanced and thereby the droplet ejecting unit can be driven at a low voltage.

One or more ejection nozzle can be provided to a single liquid column resonance chamber 18. It is preferable to have multiple ejection nozzles, preferably from 2 to 100 nozzles, in terms of enhancing the productivity.

When the number of nozzles is greater than 100, an increased voltage is applied to the vibration generating device 20 to form droplets having a desired particle diameter, which renders unstable the behavior of the piezoelectric material serving as the vibration generating device 20.

The distance between two adjacent ejection nozzles is preferably 20 μm or more and equal to the length of the liquid column resonance chamber 18 at maximum. When the distance between two adjacent nozzles is less than 20 μm, the chance of droplets ejected from the two adjacent nozzles merging is increased, resulting in deterioration of the particle diameter distribution of the resultant toner.

Next, the liquid column resonance phenomenon occurring in the liquid column resonance chamber 18 in the liquid column resonance droplet ejecting device 11 will be described with reference to FIGS. 6A to 6D. In FIGS. 6A to 6D, a solid line represents the velocity distribution of the toner liquid component 14 at any position of from the fixed end to the other end closer to the common liquid passage 17 (illustrated in FIG. 1). In this regard, the toner liquid component 14 flows from the common liquid passage 17 toward the liquid column resonance chamber 18 when the solid line is present in the positive (+) region.

When the solid line is present in the negative (−) region, the toner liquid component 14 flows in the opposite direction A dotted line represents the pressure distribution of the toner liquid component 14 at any position of from the fixed end to the other end closer to the common liquid passage 17. In this regard, when the broken line is present in the positive (+) region, the pressure in the chamber 18 is higher than atmospheric pressure (i.e., the pressure is a positive pressure). When the dotted line is present in the negative (−) region, the pressure is lower than atmospheric pressure (i.e., the pressure is a negative pressure).

Specifically, when the pressure in the chamber 18 is a positive pressure, a downward pressure is applied to the toner liquid component 14 in FIG. 6. In contrast, when the pressure is a negative pressure, an upward pressure is applied to the toner liquid component in FIG. 6.

In addition, in FIG. 6, the end of the liquid column resonance chamber 18 closer to the common liquid passage 17 is open as mentioned above and the height (h1 in FIG. 1) of the frame (fixed end) of the liquid column resonance chamber 18 is not less than about twice the height (h2 in FIG. 1) of the opening connecting the chamber 18 with the common liquid passage 17. Therefore temporal changes of the velocity distribution curve and the pressure distribution curve are illustrated in FIGS. 6A to 6D based on the assumption that the two fixed ends of the liquid column resonance chamber 18 are approximately fixed.

Figure 6A:
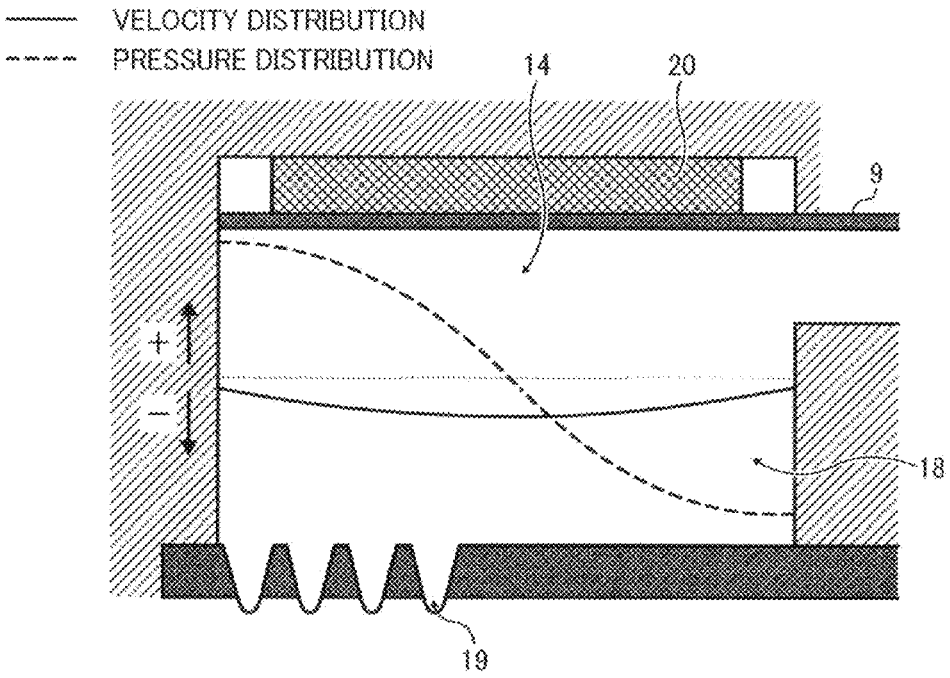
FIGS. 6A to 6D are schematic views illustrating how a liquid column resonance phenomenon occurs in a liquid column resonance chamber of the droplet ejecting device.

FIG. 6A illustrates the pressure waveform and the velocity waveform in the liquid column resonance chamber 18 just when droplets are ejected from the droplet ejection nozzles 19.

As illustrated in FIG. 6A, the pressure in a portion of the toner component liquid above the nozzles 19 in the liquid column resonance chamber 18 is maximized, and thereby the toner component liquid is excluded from the nozzles 19 as liquid columns.

Figure 6B:
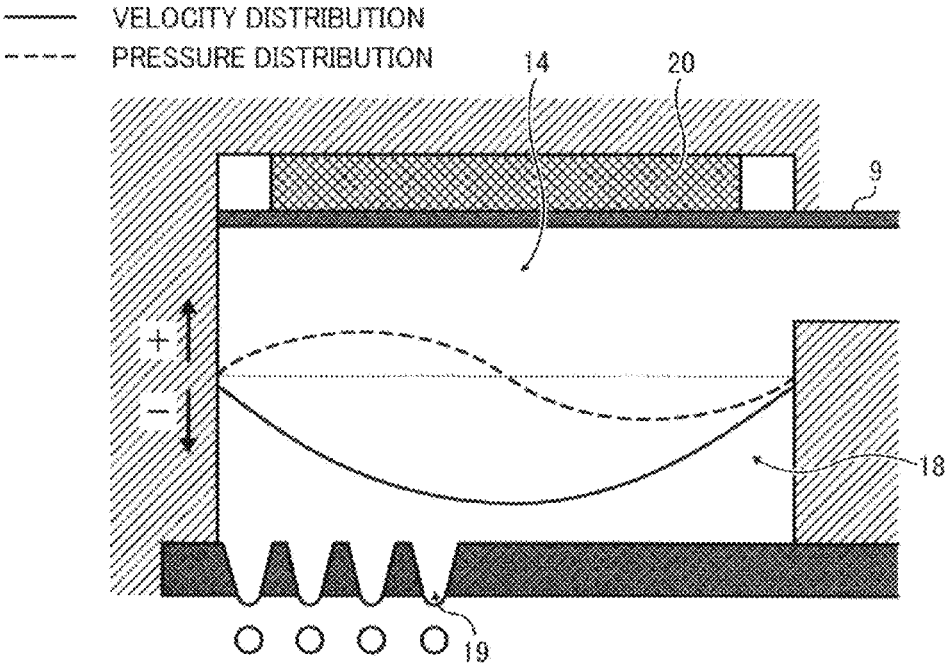

Next, as illustrated in FIG. 6B, the positive pressure in the vicinity of the nozzles 19 is decreased so as to approach the negative region (pressure), and thereby the liquid columns of the toner component liquid are cut, resulting in ejection of the droplets 21.

Figure 6C:
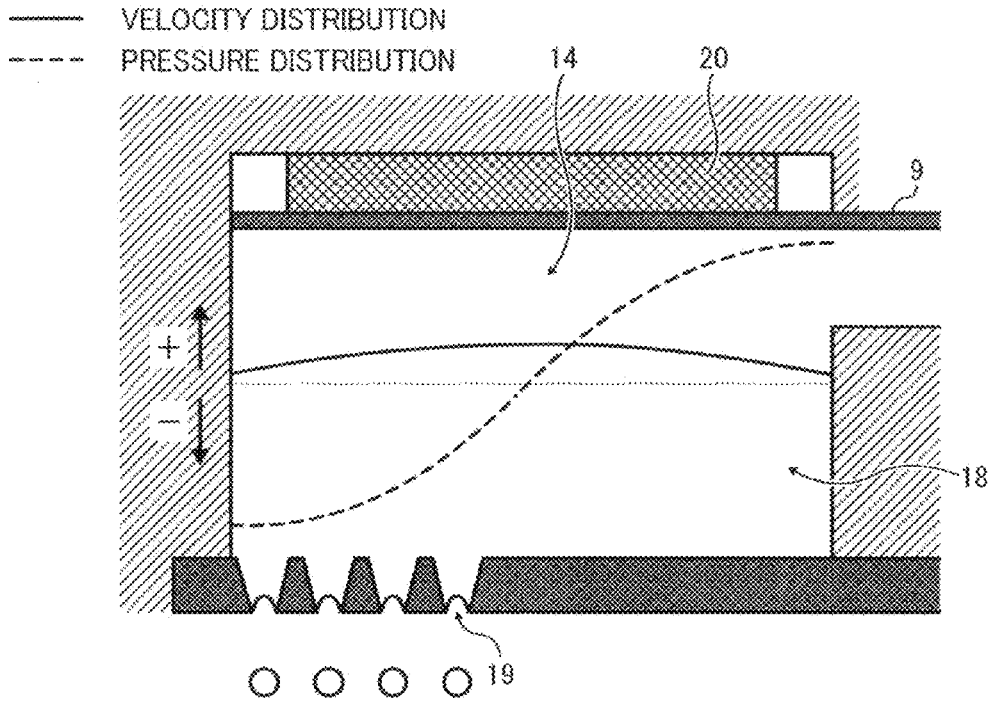

After droplets are ejected, the pressure in the vicinity of the ejection nozzles 19 is minimized (i.e., maximized in the negative region) as illustrated in FIG. 6C.

Figure 6D:
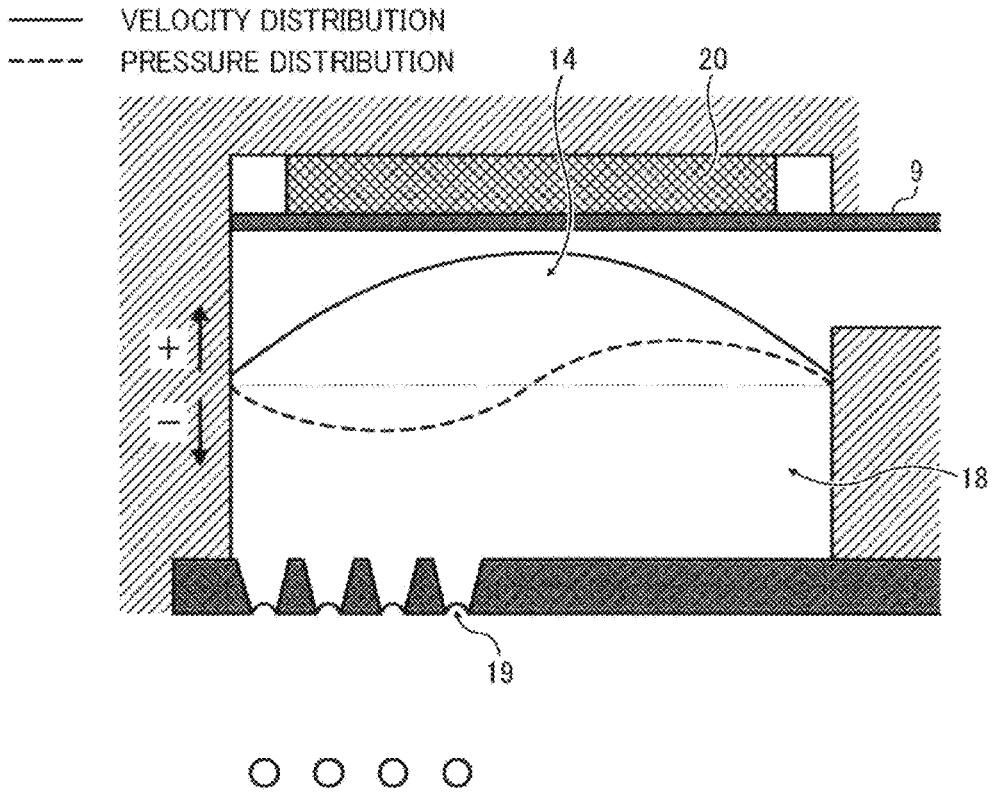

Next, as illustrated in FIG. 6D, the negative pressure in the vicinity of the ejection nozzles 19 is decreased, and the pressure is changed toward a positive pressure. Thus, filling the liquid column resonance chamber 18 with the toner liquid component 14 is completed.

Next, the positive pressure in the droplet ejection area of the liquid column resonance chamber 18 is maximized as illustrated in FIG. 6A, and then the droplets 21 of the toner component liquid 14 are ejected from the ejection nozzles 19.

Thus, filling with the toner liquid component 14 is completed. Next, the positive pressure in the droplet ejection area of the liquid column resonance chamber 18 is maximized as illustrated in FIG. 6A, and then the droplets 21 of the toner liquid component 14 are ejected from the ejection nozzles 19.

Thus, the droplets 21 are continuously ejected from the ejection nozzles 19.

Figure 7:
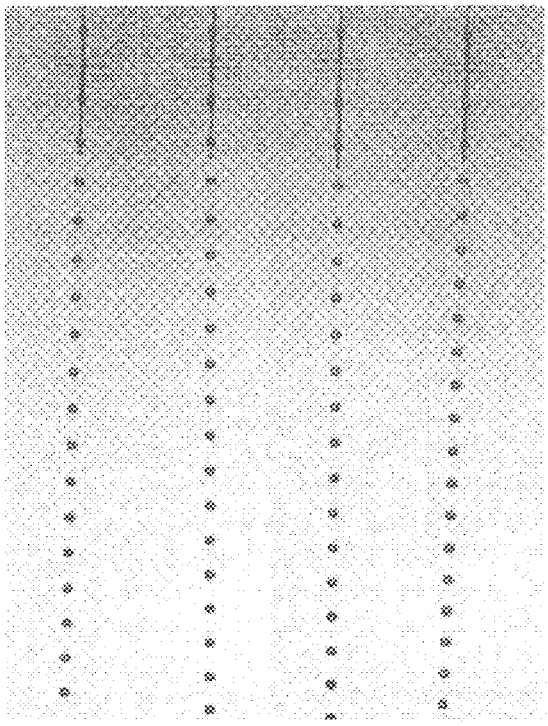
FIG. 7 is a photograph of droplets ejected from the droplet ejecting unit as taken by a laser shadowgraphy method.

An experiment on this droplet ejection operation is described. Specifically, in the droplet ejecting head used for this experiment, the length (L) of the liquid column resonance chamber 18 is 1.85 mm, and N is 2. In addition, the droplet ejection nozzles 19 have four nozzles (i.e., first to fourth nozzles) at a location corresponding to the antinode of the pressure standing wave in the N=2 mode. Further, a sine wave having a frequency of 340 kHz is used to eject droplets of a toner composition liquid. FIG. 7 is a photograph, which is taken by using a laser shadowgraphy method and which shows droplets of the toner composition liquid ejected from the four nozzles. It can be understood from FIG. 7 that droplets having substantially the same particle diameter can be ejected from the four nozzles at substantially the same velocity.

Figure 8:
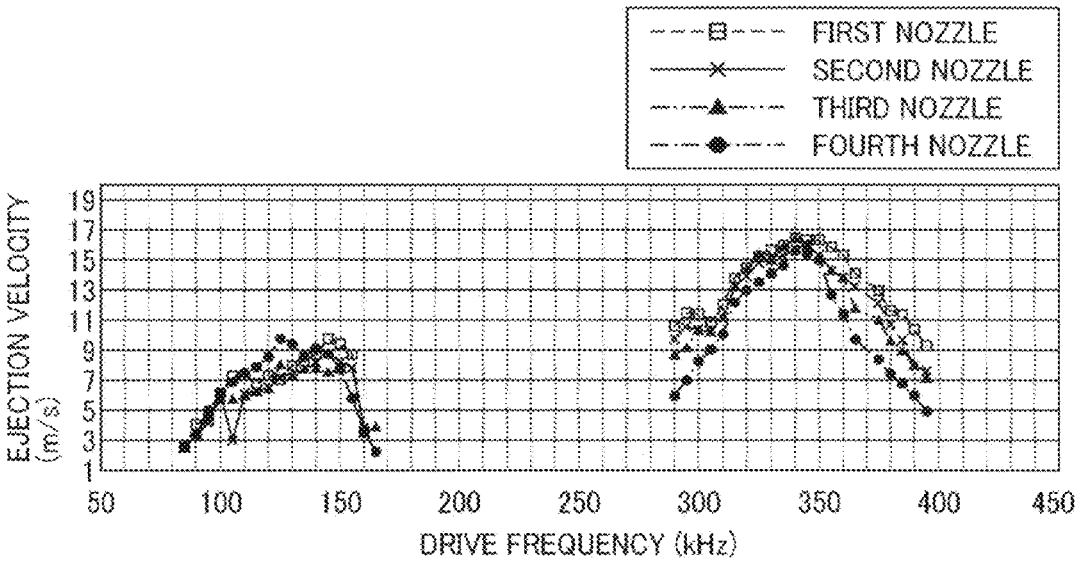
FIG. 8 is a graph illustrating a droplet velocity frequency properties when driven by the same amplitude sine wave having a driving frequency of from 290 kHz to 395 kHz.

FIG. 8 is a graph showing the velocity of droplets ejected from the first to fourth nozzles when using a sine wave with a drive frequency in a range of from 290 kHz to 395 kHz. It can be understood from FIG. 8 that at the frequency of 340 kHz, the velocities of droplets ejected from the first to fourth nozzles are substantially the same while the velocities are maximized.

Namely, it could be confirmed that droplets of the toner composition liquid are evenly ejected from the antinode of the liquid column resonance standing wave when the second mode is used (i.e., when the liquid column resonance frequency is 340 kHz).

In addition, the velocities of droplets ejected from the first to fourth nozzles when the first mode is used (i.e., when the liquid column resonance frequency is 130 kHz) are shown on the left side of the graph (FIG. 8). It can also be understood from FIG. 8 that droplets are not ejected between the first mode (130 kHz) and the second mode (340 kHz). This frequency characteristic is specific to liquid column resonance standing waves, and therefore it was confirmed that liquid column resonance occurs in the chamber 18.

Solidification of Droplets

The toner of the present disclosure is obtained by collecting solidified droplets of the toner liquid component ejected into air by the droplet ejecting device described above.

Droplet Solidifying Device

Basically, there is no specific limit to a device that changes the toner liquid component into the solid state although depending on the state of the toner liquid component. For example, if the toner liquid component is prepared by dissolving or dispersing a solid raw material in a volatile solvent, droplets thereof are sprayed into a transfer air flow to dry them by evaporating the solvent.

When drying the solvent, the drying state can be controlled by changing the temperature, the steam pressure, and the kind of the air to be sprayed. In addition, if the droplets are not completely dry but the collected particles maintain solid states, they can be additionally dried in another process provided after collecting.

It is also possible to dry the particle by temperature change, chemical reaction, etc.

Solidified Particle Collecting Device

Solidified particles in the air can be collected by a known powder collection device such as a cyclone collector and a back filter.

Figure 9:
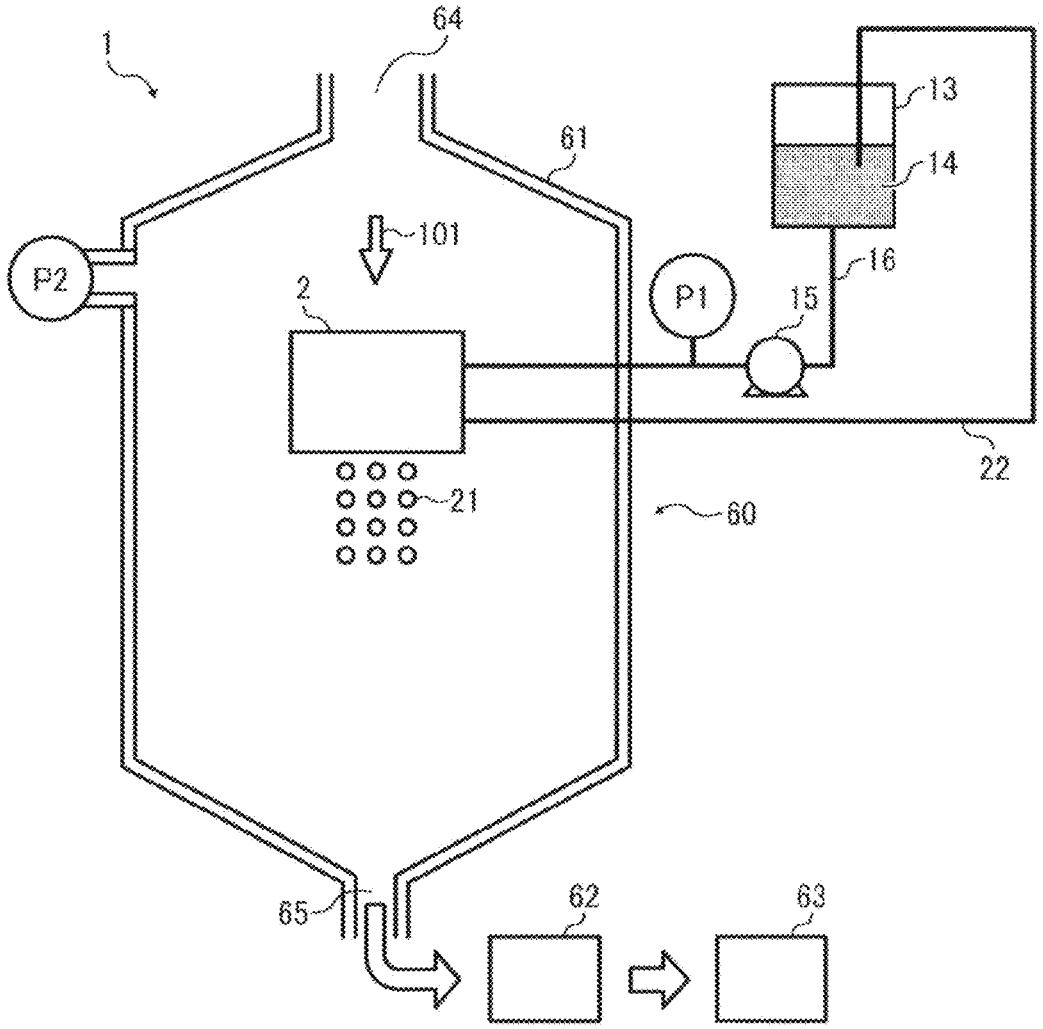
FIG. 9 is a cross section illustrating an example of a device used to conduct the method of manufacturing toner according to an embodiment of the present invention.

FIG. 9 is a cross section illustrating an example of the device to manufacture the toner of the present disclosure. A toner production apparatus 1 includes the droplet ejecting unit 2 and a drying and collecting unit 60.

The droplet ejecting unit 2 includes the droplet forming unit 10 (illustrated in FIG. 2), the raw material container 13 to contain the toner liquid component 14, and the liquid supply tube 16 through which the toner liquid component 14 in the raw material container 13 is fed to the droplet forming unit 10 of the droplet ejecting unit 2. The liquid supply tube 16 is connected with the circulating pump 15 to feed the toner liquid component 14 upon application of pressure thereto. The toner liquid component 14 is supplied to droplet forming unit 10 of the droplet ejecting unit 2, and part of the liquid is ejected from the droplet forming unit, and the residual liquid, which is not used for forming droplets, is returned to the raw material container 13 through a liquid return tube 22. A pressure gauge P1 and another pressure gauge P2 are set on the liquid supply tube 16 and a chamber 61 of the drying and collecting unit 60, respectively, to control the pressure to the toner liquid component 14 fed to the droplet forming unit 10 of the droplet ejecting unit 2 and the pressure in the chamber 61. In this regard, when the pressure P1 is greater than P2 ($P1>P2$), the toner liquid component 14 tends to exude from the nozzles 19. In addition, when the pressure P1 is less than P2 ($P1<P2$), a gas (air) tends to enter into the droplet ejecting unit, thereby often stopping ejection of droplets. Therefore, it is preferable that the pressures P1 and P2 are substantially the same ($P1 \approx P2$).

In the chamber 61, a transfer airflow 101 is formed at a transfer airflow introducing opening 64. The droplets 21 ejected from the droplet ejecting unit 2 are transferred downward by gravity and the transfer airflow 101 and collected by the particle collecting device 62. The collected droplets 21 are retained in a particle container 63. In FIG. 9, a numeral reference 65 denotes an exit of the transfer air flow 101 and the droplets 21.

Transfer Airflow

If droplets ejected from the nozzles 19 contact each other undried, the droplets merge and form a large droplet (i.e., a united droplet is formed). In order to produce solidified particles having a sharp particle diameter distribution, ejected droplets are kept away from each other to prevent such merging. However, a droplet 21 (first droplet) that is ejected from the nozzle 19 and flows at a constant speed initially loses momentum over time due to air resistance.

For this reason, the next ejected droplet catches up with and merges with the droplet ahead that has lost momentum. This phenomenon constantly occurs. For this reason, if all the particles are collected, the particle diameter distribution thereof becomes broad. In order to prevent such contact and merging of the droplets 21, it is necessary that the droplets 21 is transferred to the collecting device 62 by the transfer airflow 101 being solidified without slowing down.

As illustrated in FIG. 1, part of the transfer airflow 101 is set as the first airflow to flow in a direction parallel to the ejecting direction of the droplets 21 to prevent slowing down of the droplets 21, which leads to avoidance of merging of the droplets 21.

Figure 10:
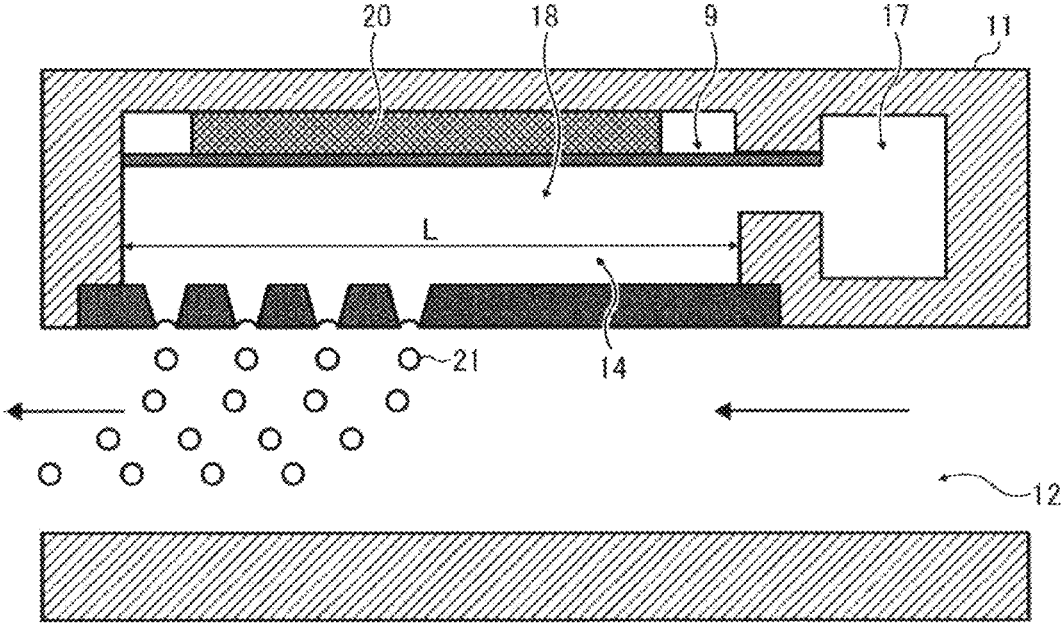
FIG. 10 is a cross section illustrating another configuration of a liquid column resonance type droplet ejecting device.

Alternatively, the first airflow can be set in a direction perpendicular to the ejecting direction of the droplets 21 as illustrated in FIG. 10. It is also possible to set the direction of the first airflow with an angle to the ejecting direction of the droplets 21 so that the ejected droplets are separated from the droplet ejecting device.

If the transfer airflow 101 flows horizontally to the droplet ejecting device 11 as illustrated in FIG. 10, it is preferable to avoid crossing of tracks of particles ejected from different nozzles.

It is also possible to provide a second air flow to transfer unmerged solidified particles to the collecting device 62 downward from the first airflow, by which the unmerged solidified particles are formed.

The speed of the first airflow is preferably not lower than the droplet ejection speed. When the speed of the first airflow is lower than the droplet ejection speed, it is difficult to demonstrate the feature of the carrier airflow to prevent contacts between droplets.

The property of the first airflow can be freely changed to securely prevent merging of the droplets 21. Therefore, the property of the first airflow and that of the second airflow are not necessarily the same. It is also suitable to add a chemical substance to accelerate solidification of the surface of the droplet 21. Also, physical effects can be expected.

There is no specific limit to the state of the transfer airflow 101. Laminar airflow, swirl flow, turbulence flow, etc. can be used. There is no specific limit to the kind of the gas of the transfer airflow 101. Air or uninflammable gases such as nitrogen are suitable. Moreover, the temperature of the transfer airflow 101 is adjustable. It is preferable that the temperature is kept the same at the production of the transfer airflow 101. Also, a device to change the state of the airflow of the transfer airflow 101 can be provided in the chamber 61.

The transfer airflow 101 does not only prevent merging of the droplets 21 and attachment thereof to the chamber 61.

Secondary Drying

Secondary drying is optionally conducted to reduce the amount of residual solvents contained in the toner particles obtained by drying and collecting unit 60 illustrated in FIG. 9. Known drying devices and method such as a fluidity bed or vacuum drying can be used to conduct secondary drying. When an organic solvent remains in toner, the properties such as the high temperature stability, the fixability, and the chargeability of toner changes over time and the chance of evaporated organic solvent doing harms to users and peripheral devices is increased. Sufficient drying has to be done.

Development Agent

The development agent of the present disclosure contains the toner of the present disclosure and other suitably selected components such as carriers.

The development agent of the present disclosure is a one-component development agent or a two-component development agent. Two-component development agents are preferable in terms of the length of the working life particularly for a high performance printer that meets the demand for high speed information processing of late.

Carrier

There is no specific limit to the carrier (toner carrier). It is preferable to use a carrier which contains a core material and a resin layer to cover the core material.

There is no specific limit to the core material and any known binder resin can be suitably used. For example, manganese-strontium (Mn—Sr) based materials and manganese-magnesium (Mn—Mg) based materials having 50 emu/g to 90 emu/g are preferable. To secure the image density, highly magnetized materials such as iron powder having 100 emu/g or more and magnetite having 75 emu/g to 125 emu/g are preferable. In addition, weakly magnetized copper-zinc (Cu—Zn) based materials having 30 emu/g to 80 emu/g are preferable in terms of reducing the impact of the contact between the toner filaments formed on the development roller and the image bearing member, which is advantageous to improve the image quality. These can be used alone or in combination.

The core material preferably has a weight average particle diameter D50 of from 10 μm to 200 μm and more preferably from 40 μm to 100 μm.

When the volume average particle diameter D50 is too small, fine powder tends to increase in the distribution of the carrier particles and the magnetization per particle tends to decrease, which leads to scattering of the carrier particles. When the volume average particle diameter D50 is too large, the specific surface area tends to decrease, resulting in scattering of toner. In a full color image in which solid portions account for a large ratio, reproducibility tends to deteriorate particularly in the solid portions.

There is no specific limit to the material to cover the core material. Any known resin can be selected for use. Specific examples thereof include, but are not limited to, amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, copolymers of vinylidene fluoride resins and acrylic monomers, copolymers of vinyl fluoride and vinylidene fluoride, fluoro terpolymers such as copolymers of tetra fluoroethylene, vinylidene fluoride, and monomers including no fluorine atom, and silicone resins.

These can be used alone or in combination. Of these, silicone resins are preferable in terms of prevention effect of toner filming on toner carrier.

There is no specific limit to the silicone resin to form a resin layer. Any known resin can be selected for use to a particular application. Specific examples thereof include, but are not limited to, straight silicone resins formed of only organosiloxane bond, an alkyd resin, a polyester resin, an epoxy resin, an acrylic resin, a silicone resin modified by a urethane resin, etc.

Products of silicone resins available on the market can be used. Specific examples of the straight silicone resin include, but are not limited to, KR271, KR255, and KR152, manufactured by Shin-Etsu Chemical Co., Ltd.; and SR2400, SR2406, and SR2410, manufactured by DOW CORNING TORAY CO., LTD.

Products of modified silicone resins available on the market can be used. Specific examples thereof include, but are not limited to, KR206 (alkyd-modified), KR5208 (acrylic-modified), ES1001N (epoxy-modified), and KR305 (urethane-modified) manufactured by Shin-Etsu Chemical Co., Ltd.; and SR2115 (epoxy-modified), and SR2110 (alkyd-modified), manufactured by DOW CORNING TORAY CO., LTD.

It is possible to use a simple silicone resin and also possible to use it with a component that conducts cross-linking reaction, a charge-control component, etc. simultaneously.

The resin layer to cover a core material optionally contains electroconductive powder such as metal powder, carbon black, titanium oxide, tin oxide, and zinc oxide.

The average particle diameter of such electroconductive powder is preferably not greater than 1 μm. When the average particle diameter is too large, controlling electric resistance may become difficult.

The resin layer to cover a core material can be formed by, for example, dissolving the silicone resin described above, etc. in an organic solvent to prepare a liquid application and applying the liquid application to the surface of the core material described above by a known application method followed by drying and baking. Specific examples of the known application methods include, but are not limited to, a dip coating method, a spray coating method, and a brushing method.

There is no specific limit to the organic solvent. Specific examples thereof include, but are not limited to, toluene, xylene, methylethylketone, methylisobutyl ketone, and cellosolve, and butylacetate.

There is no specific limit to the baking of the resin layer. An external heating system or an internal heating system can be used. For example, a fixed electric furnace, a fluid electric furnace, a rotary electric furnace, a method of using a burner furnace, and a method of using a microwave can be suitably used.

The content of the carrier in the resin layer is preferably from 0.01% by weight to 5.0% by weight. A content that is too small tends to make it difficult to form a uniform layer on the surface of a core material. A content that is too large tends to result in an excessively thick layer, thereby causing granulation between carrier particles so that uniform carrier particles are not obtained.

When the development agent of the present disclosure is a two-component development, there is no specific limit to the content of carrier in the two-component development. A suitable two-component development is selected to a particular application. The mixing ratio of toner in a two-component development is from 1 part by weight to 10.0 parts by weight to 100 parts of the carrier.

Image Forming Method and Image Forming Apparatus

The image formation method of the present disclosure includes a latent electrostatic image forming process, a development process, a transfer process, and a fixing process with optional processes such as a cleaning process, a discharging process, a recycling process, and a control process.

The image forming apparatus includes at least a latent electrostatic image bearing member, a latent electrostatic image forming device to form a latent electrostatic image on the latent electrostatic image bearing member, a development agent to develop the latent electrostatic image with the toner of the present disclosure to form a visible image, a transfer device to transfer the visible image to a recording medium, and a fixing device to fix the transferred image. It can also include other optional devices such as a discharging device, a cleaning device, a recycling device, and a control device.

Latent Image Forming Process and Device

The latent electrostatic image forming process is to form a latent electrostatic image on a latent electrostatic image bearing member.

There is no specific limit to the latent electrostatic image bearing member (also referred to as image bearing member or photoreceptor) with regard to material, form, structure, size, etc. and any known image bearing member can be suitably selected. An image bearing member having a drum form is preferred. Also, for example, an inorganic image bearing member is formed of amorphous silicone or selenium and an organic image bearing member [organic photoconductor (OPC)] is formed of polysilane or phthalopolymethine.

Among these, amorphous silicon, etc. is preferred in terms of long working life.

Latent electrostatic images are formed by, for example, uniformly charging the surface of the image bearing member and irradiating the surface according to the obtained image information using the latent electrostatic image forming device.

The latent electrostatic image forming device includes at least a charger which uniformly charges the surface of the image bearing member, an irradiator which irradiates the surface of the image bearing member according to the obtained image information.

The surface of the image bearing member is charged by, for example, applying a voltage to the surface of the image bearing member with the charger.

There is no specific limit to the charger and any known charger can be selected. A known contact type charger having an electroconductive or semi-electroconductive roll, brush, film, rubber blade, etc. and a non-contact type charger such as a corotron or a scorotron which uses corona discharging can be used.

It is preferable to apply a direct current or a voltage obtained by superimposing an alternate current voltage on a direct current voltage to the surface of the latent electrostatic image bearing member by the charging device arranged in contact with or in the vicinity of the latent electrostatic image bearing member.

It is preferable to apply a direct current or a voltage obtained by superimposing an alternate current voltage on a direct current voltage to the surface of the latent electrostatic image bearing member by the charging device arranged in contact with or in the vicinity of the latent electrostatic image bearing member.

The irradiation is conducted by, for example, irradiating the surface of the image bearing member with the irradiator according to image data.

There is no specific limit to the irradiator which can expose the surface of the latent electrostatic image bearing member described above charged by the charger described above to light to form an image according to acquired image information. Specific examples of such irradiators include, but are not limited to, a photocopying optical system, a rod lens array system, a laser optical system, and a liquid crystal shutter optical system.

As to the present disclosure, the rear side irradiation system in which an image bearing member is irradiated from the rear side thereof can be also employed.

Development Process and Development Device

The development process is a process of forming a visible image by developing the latent electrostatic image with the toner or the development agent of the present disclosure.

The visible image is formed by, for example, developing the latent electrostatic image by the development device with the toner or the development agent of the present disclosure.

Any known development device that can conduct development with the toner or the development agent of the present disclosure is suitably selected. For example, a development device that has a development unit which accommodates the toner or the development agent of the present disclosure and provides the toner or the development agent to the latent electrostatic image in a contact or non-contact manner is suitably usable and the development unit that accommodates the development agent container is preferable.

The development device is either of a single color development type or a multi-color development type. The development device suitably includes, for example, a stirrer to triboelectrically charge the toner or the development agent and a rotatable magnet roller.

In the development device, the toner and the carrier described above are mixed and stirred to triboelectrically charge the toner due to friction therebetween. The toner is then held on the surface of the rotatable magnet roller to form a magnet brush like a filament. Since the magnet roller is provided in the vicinity of the latent electrostatic image bearing member, part of the toner forming the magnet brush borne on the surface of the magnet roller is transferred to the surface of the latent electrostatic image bearing member by the force of the electric attraction. As a result, the latent electrostatic image is developed with the toner and visualized as a toner image on the surface of the image bearing member.

The development agent accommodated in the development device is the development device of the present disclosure.

Transfer Process and Transfer Device

The transfer process mentioned above is to transfer the visible image mentioned above to a recording medium. It is preferable that the visible image is primarily transferred to an intermediate transfer body and thereafter secondarily transferred to the recording medium.

Further, it is more preferable to use a two-color toner, preferably a full color toner, in the processes in which the visible image is primarily transferred to an intermediate transfer body to form a complex transfer image and the complex transfer image is thereafter secondarily transferred to the recording medium.

The visible image is transferred by, for example, charging the latent electrostatic image bearing member (photoreceptor) using a transfer charging unit in the transfer device.

The transfer device preferably has a primary transfer device to form a complex transfer image by transferring the visible image to an intermediate transfer body and a secondary transfer device to transfer the complex transfer image to a recording medium.

There is no specific limit to the selection of the intermediate transfer body. Any known transfer body such as an intermediate transfer belt can be suitably selected and used.

The transfer device (the primary transfer device and the secondary transfer device) preferably has a transfer unit which peeling-charges the visible image formed on the latent electrostatic image bearing member to the side of the recording medium.

One or more transfer devices can be provided.

Specific examples of the transfer units include, but are not limited to, a corona transfer unit using corona discharging, a transfer belt, a transfer roller, a pressure transfer roller, and an adhesive transfer unit.

There is no specific limit to the recording medium and any known recording medium (typically paper) can be suitably used to a particular application.

Fixing Process and Fixing Device

The fixing process is a process in which the visible image transferred to the recording medium is fixed by a fixing device. Fixing can be performed every time each color toner image is transferred or at once for a multi-color overlapped (superimposed) image.

Any fixing device can be suitably selected. Any known heating and pressure device can be used. Known pressure and heating devices are preferably used and formed of, for example, a combination of a heating roller and a pressure roller or a combination of a heating roller, a pressure roller and an endless belt.

For example, a suitable fixing device has a heating body that has a heat-generating element, a film in contact with the heating body, and a pressing member that presses the hearing body via the film to fix the un-fixed image on a recording medium while the recording medium passes between the film and the pressing member. The heating temperature by the heating and pressure device is preferably from 80° C. to 200° C.

In the fixing process for use in the present disclosure, for example, any known optical fixing device can be used together with or in place of the fixing device and the fixing process described above.

The discharging process is a process in which a discharging bias is applied to the latent electrostatic image bearing member to discharge the latent electrostatic image bearing member and is suitably performed by a discharging device.

There is no specific limit to the discharging device and any known discharging device is suitably usable. For example, a discharging lamp is suitable.

The cleaning process is to remove toner remaining on the surface of the latent image bearing member and can be suitably conducted by a cleaning device.

Any known cleaning device that can remove the toner remaining on the surface of the latent image bearing member is suitably selected and used. For example, a magnetic brush cleaner, an electrostatic brush cleaner, a blade cleaner, a brush cleaner, and a web cleaner are preferable.

The recycling process is a process in which the toner removed in the cleaning process mentioned above is returned to the development device for re-use. This recycling process is suitably conducted by a recycling device.

There is no specific limit to the recycling device and any known conveying device, etc., can be used.

The controlling process mentioned above is a process of controlling each process and the controlling can be suitably performed by a controlling device.

There is no specific limit to the control device as long as it can control the behavior of each device. Any control device is suitably usable. For example, devices such as a sequencer and a computer can be used.

Figure 11:
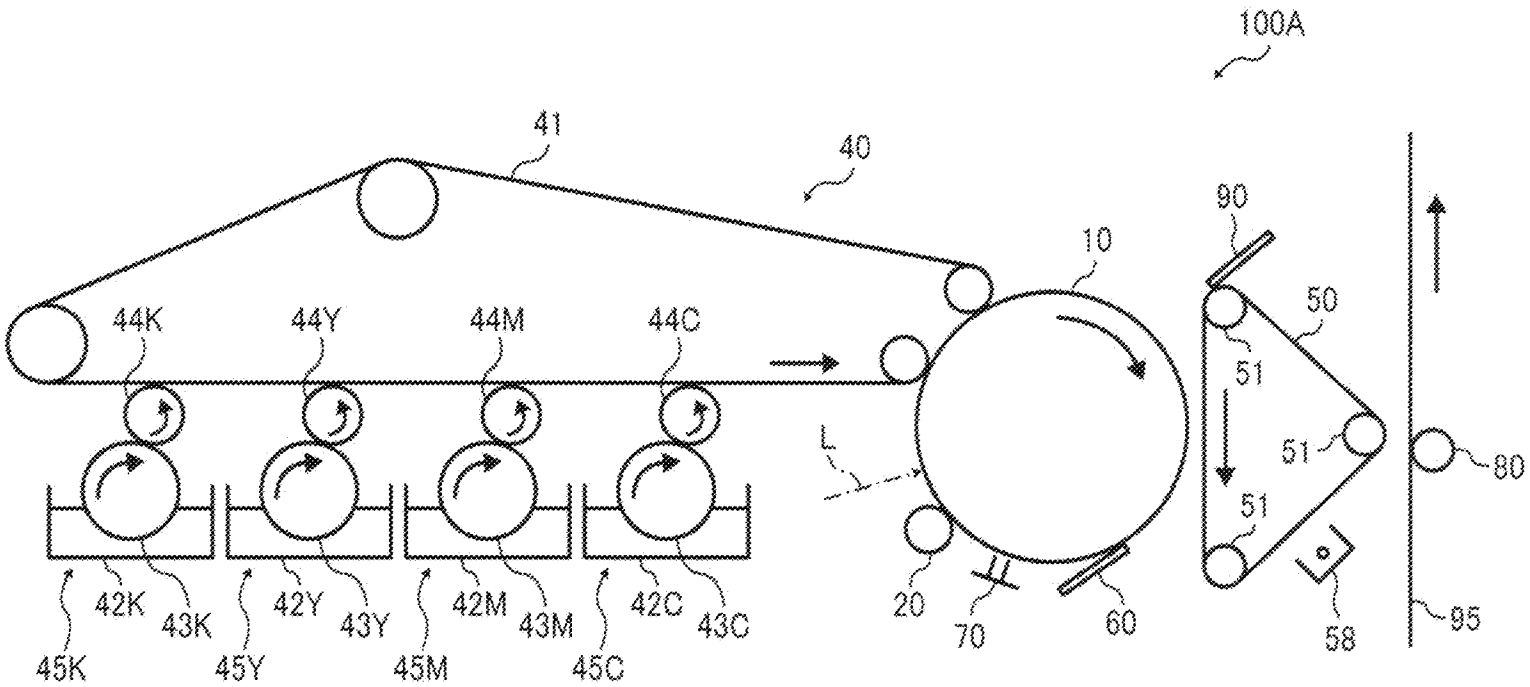
FIG. 11 is a schematic diagram illustrating an example of the image forming apparatus according to an embodiment of the present invention.

FIG. 11 is a diagram illustrating an example of the image forming apparatus for use in the present disclosure.

An image forming apparatus 100A includes an image bearing drum 10, a charging roller 20, an irradiator, a development device 40, an intermediate transfer belt 50, a cleaning device 60 having a cleaning blade, and a discharging lamp 70.

The intermediate transfer belt 50 is an endless belt suspended over three rollers 51 provided inside and moves in the direction indicated by an arrow in FIG. 11. Part of the three rollers 51 has a feature as a transfer bias roller that can apply a transfer bias (primary transfer bias) to the intermediate transfer belt 50.

Around the intermediate transfer belt 50, there is arranged a cleaning device 90 having a cleaning blade.

Furthermore, a transfer roller 80 that can apply a transfer bias (secondary transfer bias) to a transfer sheet 95 to transfer the toner image thereto is provided facing the intermediate transfer belt 50. In addition, around the intermediate transfer belt 50, there is provided a corona charger 58 to impart charges on the toner image transferred to the intermediate transfer belt 50 between the contact portion of the image bearing drum 10 and the intermediate transfer belt 50 and the contact portion between the intermediate transfer belt 50 and the transfer sheet 95 relative to the rotation direction of the intermediate transfer belt 50.

The development device 40 includes a development belt 41, a black development unit 45K, a yellow development unit 45Y, a magenta development unit 45M, and a cyan development unit 45C provided around the development belt 41. Each development unit 45 (45Y, 45M, 45C, and 45K) has a development agent container 42 (42Y, 42M, 42C, and 42K), a development supplying roller 43 (43Y, 43M, 43C, and 43K), and a development roller 44 (44Y, 44M, 44C, and 44K). In addition, the development belt 41 is an endless belt suspended over multiple belt rollers and moves in the direction indicated by an arrow in FIG. 11.

Furthermore, part of the development belt 41 contacts the image bearing drum 10.

The method of forming images using the image forming apparatus 100A is described next. First, after charging the surface of the image bearing drum 10 using the charging roller 20, a latent electrostatic image is formed by irradiating the image bearing drum 10 with irradiation light L.

Next, the latent electrostatic image formed on the image bearing drum 10 is developed with the toner supplied from the development device 40 to form a toner image. Moreover, the toner image formed on the image bearing drum 10 is (primarily) transferred to the intermediate transfer belt 50 by a transfer bias applied by the roller 51 and thereafter (secondarily) transferred to the transfer sheet 95 by a transfer bias applied by the transfer roller 80.

With regard to the image bearing drum 10 from which the toner image has been transferred to the intermediate transfer belt 50, the toner remaining on the surface is removed by the cleaning device 60 and thereafter discharged by the discharging lamp 70.

Figure 12:
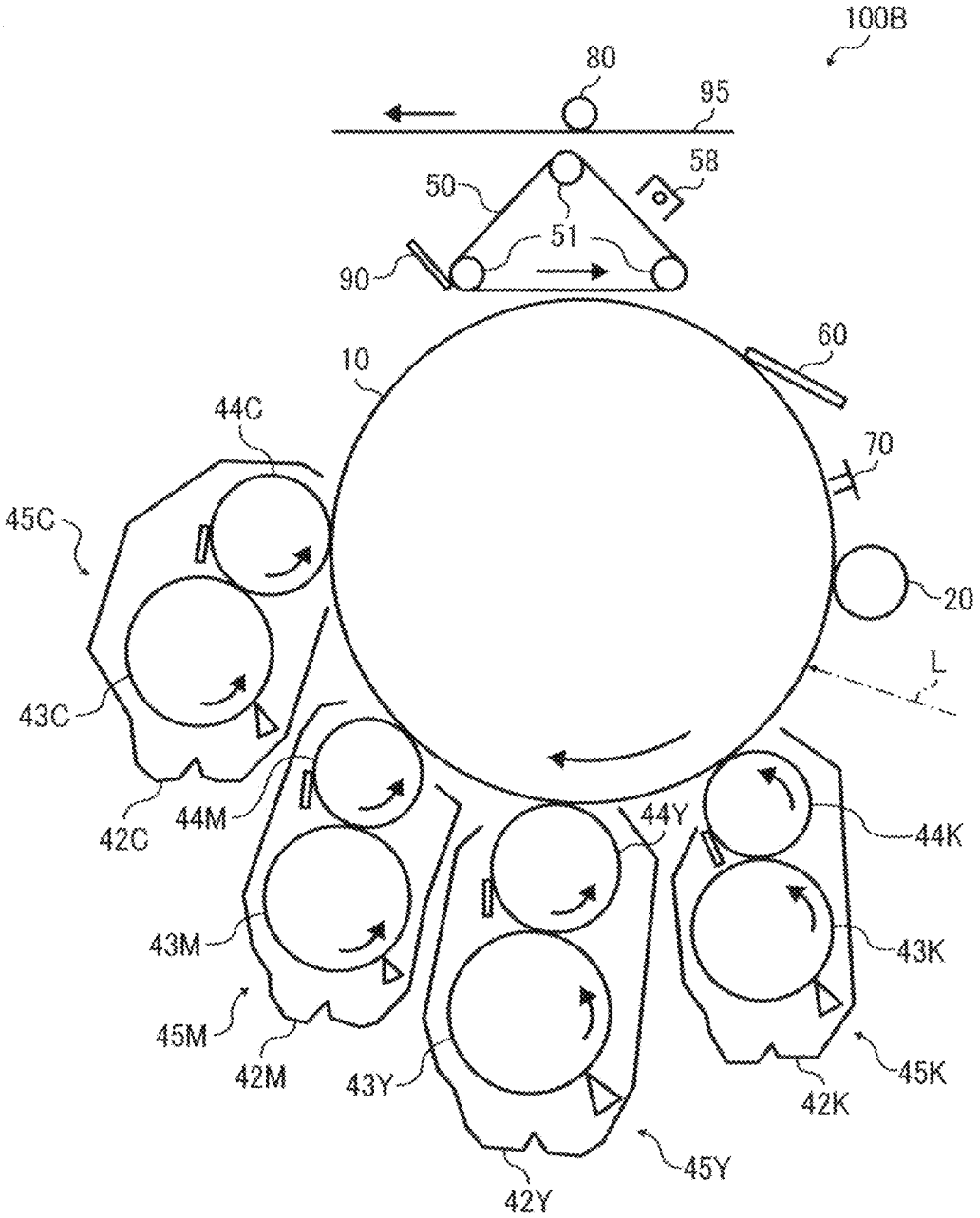
FIG. 12 is a schematic diagram illustrating another example of the image forming apparatus according to an embodiment of the present invention.

FIG. 12 is a diagram illustrating another example of the image forming apparatus for use in the present disclosure.

An image forming apparatus 100B has the same structure as the image forming apparatus 100A except that the black development unit 45K, the yellow development unit 45Y, the magenta development unit 45M, and the cyan development unit 45C are provided around the image bearing drum 10 while directly facing the image bearing drum 10 with no development belt 41.

Figure 13:
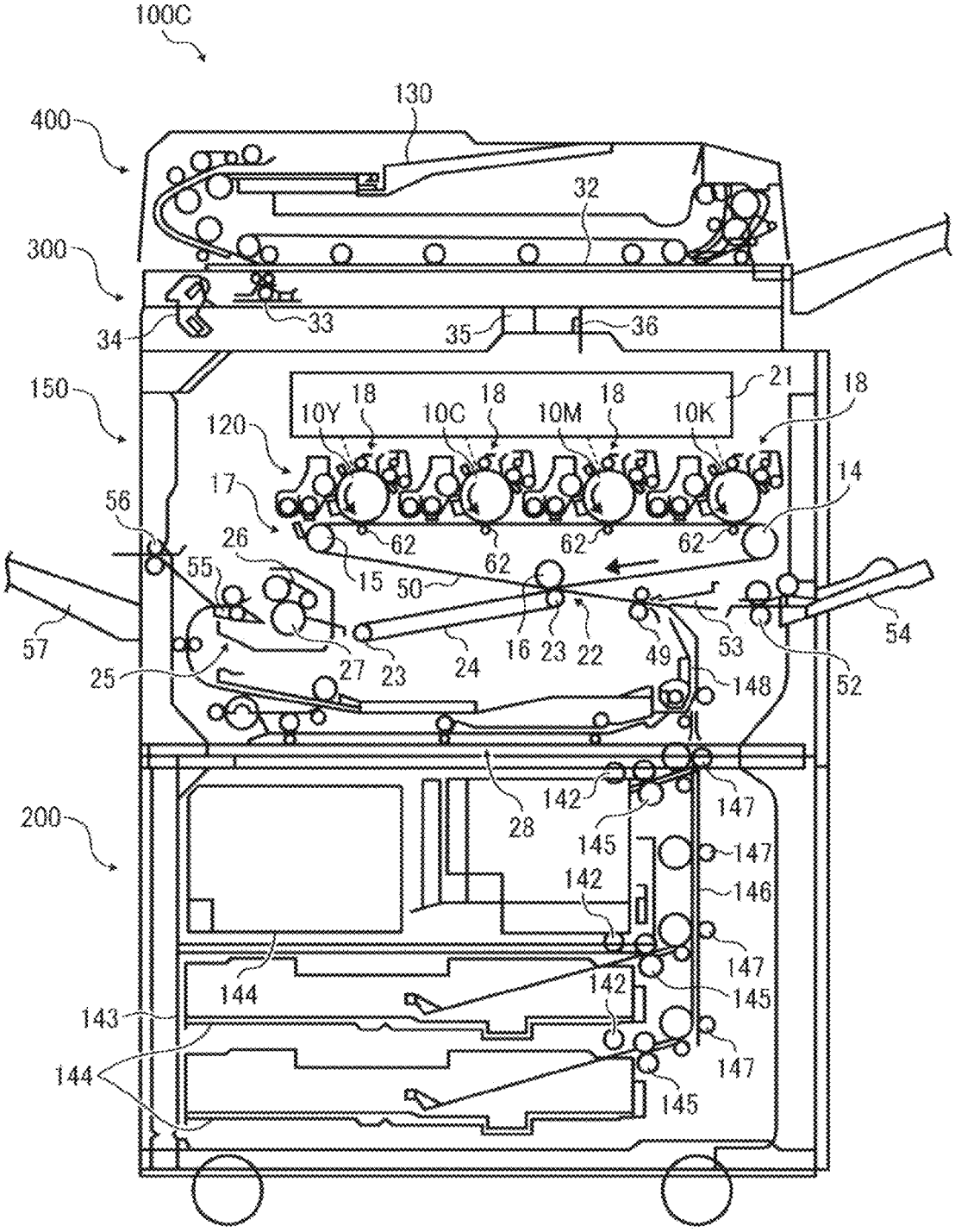
FIG. 13 is a schematic diagram illustrating an example of the full color tandem type image forming apparatus according to an embodiment of the present invention.

FIG. 13 is a diagram illustrating a third example of the image forming apparatus for use in the present disclosure.

An image forming apparatus 100C is a tandem type color image forming apparatus, and includes a photocopying unit 150, a sheet feeder table 200, a scanner 300, and an automatic document feeder (ADF) 400.

The intermediate transfer belt 50 provided at the center of the photocopying unit 150 is an endless belt suspended over three rollers 14, 15, and 16 and moves in the direction indicated by an arrow in FIG. 4.

Around the roller 15, a cleaning device 17 is provided which has a cleaning blade to remove toner remaining on the intermediate transfer belt 50 from which the toner image is transferred to a recording medium. Image formation units 120Y, 120C, 120M, and 120K for yellow, cyan, magenta and black, respectively are arranged along the transfer direction of the intermediate transfer belt 50 facing the intermediate transfer belt 50 suspended between the rollers 14 and 15.

In addition, an irradiation device 21 is arranged near an image formation unit 120. Furthermore, a secondary transfer belt 24 is arranged on a side opposite to the side on which the image formation unit 120 is provided relative to the intermediate transfer belt 50.

The secondary transfer belt 24 is an endless belt suspended over a pair of rollers 23 and the recording medium transferred on the transfer belt 24 and the intermediate transfer belt 50 can contact each other between the rollers 16 and 23. In addition, around the secondary transfer belt 24, there are arranged a fixing belt 26 suspended over a pair of rollers and a fixing device 25 having a pressing roller 27 pressed to the fixing belt 26. Furthermore, close to the secondary transfer belt 24 and the fixing device 25, there is provided a sheet reversing device 28 to reverse the recording medium to form images on both sides of the recording medium.

A method of forming full color images using the image forming apparatus 100C is described. First, a color document is set on a document table 130 of the automatic document feeder (ADF) 400, or after the automatic document feeder 400 is opened, a color document is set on a contact glass 32, and then the automatic document feeder 400 is shut.

After the document moves to the contact glass 32 by pressing a start button in a case in which the document is set on the automatic document feeder 400 or immediately in a case in which the document is set on the contact glass 32, the scanner 300 is driven to start scanning with a first scanning unit 33 having a light source and a second scanning unit 34 having a mirror.

The irradiation light from the first carrier 33 is reflected at the document and the reflected light is reflected at the second carrier 34. Thereafter, the reflected light is received at a reading sensor 36 via an image focusing lens 35 to read the document and thus image information of black, yellow, magenta, and cyan of the document is obtained.

Image information of each color is transmitted to each color image formation unit 120 where each color toner image is formed.

Figure 14:
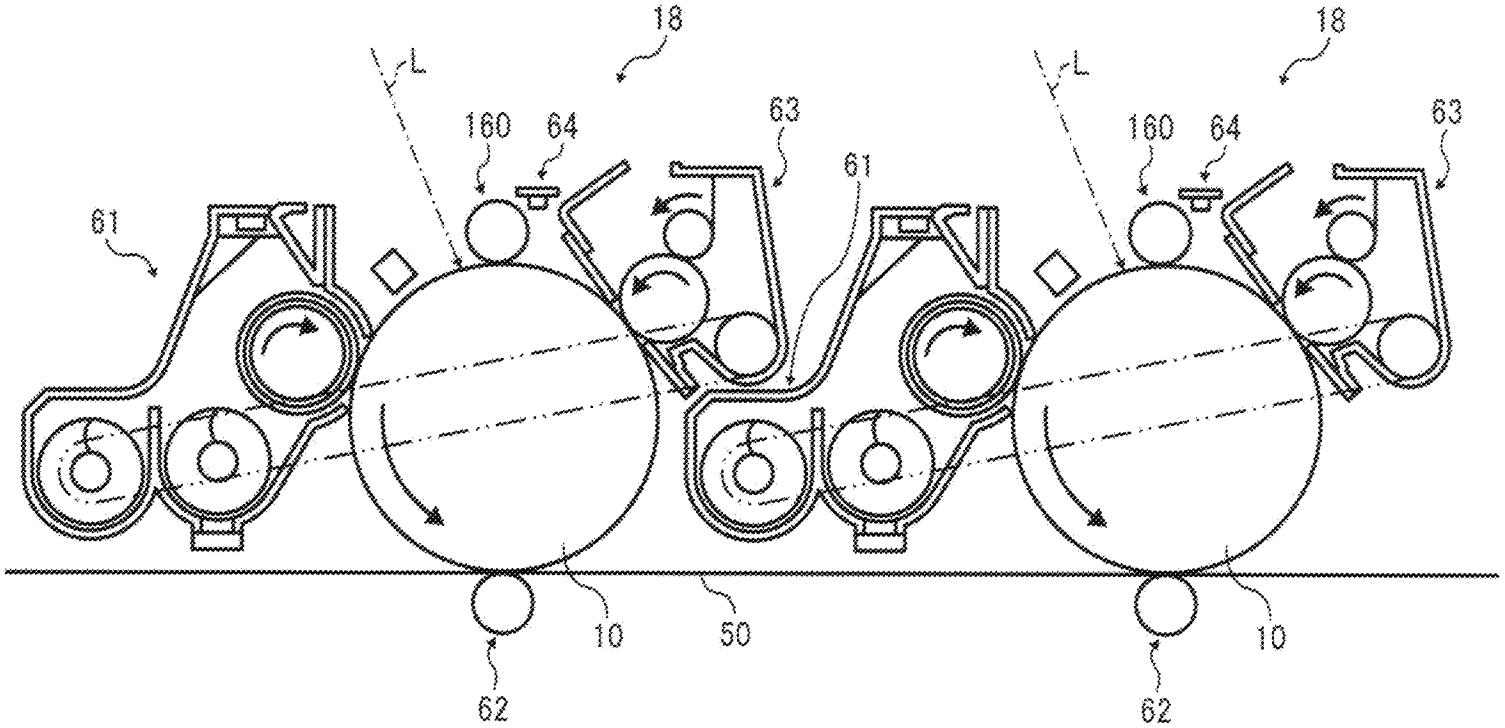
FIG. 14 is an enlarged schematic diagram of a portion of the image forming apparatus illustrated in FIG. 13.

As illustrated in FIG. 14, each color image formation unit 120 includes an image bearing drum 10, a charging roller 160 that charges the image bearing drum 10 (10Y, 10C, 10M, and 10K), an irradiator to form each color latent electrostatic image by irradiating the image bearing drum 10 with irradiation light L, a development device 61 to form each color toner image by developing a latent electrostatic image with each color development agent, a transfer roller 62 to transfer the toner image to the intermediate transfer belt 50, a cleaning device 63 having a cleaning blade, and a discharging lamp 64.

Each color toner image formed on each image formation unit 120 is sequentially and primarily transferred to the intermediate transfer belt 50 suspended over the rollers 14, 15, and 16 to superimpose a complex toner image.

In the sheet feeder table 200, one of the sheet feeder rollers 142 is selectively rotated to bring up recording media (sheets) from one of multiple sheet cassettes 144 stacked in a sheet bank 143. A separating roller 145 separates the recording media one by one to feed it to a sheet path 146. Transfer rollers 147 transfer and guide the recording medium to a sheet path 148 in the main portion 150 of the image forming apparatus 100 and the recording medium strikes at a registration roller 49 and is held there.

Alternatively, the recording media on a manual tray 54 are brought up by rotating a sheet feeding roller, and separated one by one by a separating roller 52, transferred to a manual sheet path 53, and struck and held at a registration roller 49.

The registration roller 49 is typically grounded but a bias can be applied thereto to remove paper dust on the recording medium.

The registration roller 49 is rotated in synchronization with the complex toner image (color transfer image) on the intermediate transfer belt 50 to send the recording medium (sheet) between the intermediate transfer belt 50 and the secondary transfer device 24 and secondarily transfer the complex toner image to the recording medium. The toner remaining on the intermediate transfer belt 50 from which the complex toner image has been transferred is removed by the cleaning device 17.

The recording medium to which the complex toner image is transferred is transferred by the secondary transfer belt 24 and then fixed by the fixing device 25. Next, the recording medium is discharged on a discharging tray 57 by a discharging roller after a switching claw 55 switches the transfer path.

Alternatively, after switching claw 55 switches the transfer path, the recording medium is reversed by the sheet reversing device 28 and an image is formed on the reverse side of the recording medium and thereafter the recording medium is discharged on the discharging tray 57 by the discharging roller 56.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

It is to be noted that it will be apparent to one of ordinary skill in the art that many suitable changes and modifications can be made to the embodiments of the present invention described above to make other embodiments, these changes and modifications are within the scope of the present invention, and the following descriptions are merely examples in preferable embodiments of the present invention and are not limiting.

Synthesis of Binder Resin

Manufacturing Example 1

Manufacturing of Crystalline Polyurethane Resin A-1

45 parts (0.50 mol) of 1,4-butane diol, 59 parts (0.50 mol) of 1,6-hexane diol, and 200 parts of methylethyl ketone (MEK) were placed in a reaction container equipped with a stirrer and a thermometer. 250 parts (1.00 mol) of 4,4'-diphenyl methane diisocyanate (MDI) was added to this solution to conduct reaction at 80° C. for five hours and remove the solvent to obtain [Crystalline Polyurethane Resin A-1]. The thus-obtained [Crystalline Polyurethane Resin A-1] had an Mw of 20,000 and a melting point of 60° C.

Manufacturing Example 2

Manufacturing of Urethane-Modified Crystalline Polyester Resin A-2

202 parts (1.00 mol) of sebacic acid, 15 parts (0.10 mol) of adipi acid, 177 parts (1.50 mol) of 1,6-hexane diol, and 0.5 parts of tetrabutoxy titanate as a condensing catalyst were placed in a reaction container equipped with a condenser, a stirrer, and a nitrogen introducing tube to conduct reaction at 180° C. for eight hours in a nitrogen atmosphere while distilling away produced water.

Next, reaction was conducted for four hours while gradually heating the system to 220° C. and distilling away produced water and 1,6-hexane diol in a nitrogen atmosphere. Thereafter, the reaction was continued with a reduced pressure of from 5 mmHg to 20 mmHg until the Mw reached about 12,000 to obtain [Crystalline Polyester Resin A'-2].

The thus-obtained [Crystalline Polyester Resin A'-2] had an Mw of 12,000.

The thus obtained [Crystalline Polyester Resin D'-2] was transferred to a reaction container equipped with a condenser, a stirrer, and a nitrogen introducing tube. Thereafter, 350 parts of ethyl acetate and 30 parts (0.12 mol) of 4,4'-diphenyl methane diisocyanate (MDI) were added thereto to conduct reaction at 80° C. in a nitrogen atmosphere for five hours.

Next, ethyl acetate was distilled away under a reduced pressure to obtain [Urethane-Modified Crystalline Polyurethane Resin A-2]. The thus-obtained [Urethane-Modified Crystalline Polyester Resin A-2] had an Mw of 22,000 and a melting point of 62° C.

Manufacturing Example 3

Manufacturing of Crystalline Polyurethane Resin A-3

123 parts (1.40 mol) of 1,4-butane diol, 212 parts (1.82 mol) of 1,6-hexane diol, and 100 parts of methylethylketone (MEK) were placed in a reaction container equipped with a condenser, a stirrer, and a nitrogen introducing tube followed by stirring. 336 parts (2.00 mol) of hexamethylene diisocyanate (HDI) was added thereto to conduct reaction at 60° C. in a nitrogen atmosphere for five hours. MEK was removed by distilling away under a reduced pressure to obtain [Crystalline Polyurea Resin A-3].

The thus-obtained [Crystalline Polyurea Resin A-3] had an Mw of 23,000 and a melting point of 64° C.

Manufacturing Example 4

Manufacturing of Crystalline Polyester Resin A-4

185 parts (0.91 mol) of sebacic acid, 13 parts (0.09 mol) of adipic acid, 125 parts (1.39 mol) of 1,4-butane diol, and 0.5 parts of titanium dihydroxybis(triethanol aminate) as a condensing catalyst were placed in a reaction container equipped with a condenser, a stirrer, and a nitrogen introducing tube to conduct reaction for eight hours at 180° C. in a nitrogen atmosphere while distilling away produced water.

Next, reaction was conducted for four hours while gradually heating the system to 220° C. and distilling away produced water and 1,4-butane diol in a nitrogen atmosphere.

Thereafter, the reaction was continued with a reduced pressure of from 5 mmHg to 20 mmHg until the weight average molecular weight Mw of the resultant reached about 10,000 to obtain [Crystalline Polyester Resin A-4].

The thus-obtained [Crystalline Polyester Resin A-4] had an Mw of 9,500 and a melting point of 57° C.

Manufacturing Example 5

Manufacturing of Urethane-Modified Crystalline Polyester Resin B-1

113 parts (0.56 mol) of sebacic acid, 109 parts (0.56 mol) of dimethyl terephthalate, 132 parts (1.12 mol) of 1,6-hexane diol, and 0.5 parts of titanium dihydroxybis(triethanol aminate) as a condensing catalyst were placed in a reaction container equipped with a condenser, a stirrer, and a nitrogen introducing tube to conduct reaction at 180° C. for eight hours in a nitrogen atmosphere while distilling away produced water and methanol.

Next, reaction was conducted for four hours while gradually heating the system to 220° C. and distilling away produced water and 1,6-hexane diol in a nitrogen atmosphere. Thereafter, the reaction was continued with a reduced pressure of from 5 mmHg to 20 mmHg until the Mw reached about 35,000 to obtain [Crystalline Polyester Resin B'-1].

The thus-obtained [Crystalline Polyester Resin B'-1] had an Mw of 34,000.

The thus-obtained [Crystalline Polyester Resin B'-1] was transferred to a reaction container equipped with a condenser, a stirrer, and a nitrogen introducing tube. 200 parts of ethyl acetate and 10 parts (0.06 mol) of hexamethylene diisocyanate (HDI) were added thereto to conduct reaction at 80° C. in a nitrogen atmosphere for five hours.

Next, ethyl acetate was distilled away under a reduced pressure to obtain [Urethane-Modified Crystalline Polyurethane Resin B-1].

The thus-obtained [Urethane-Modified Crystalline Polyester Resin B-1] had an Mw of 63,000 and a melting point of 65° C.

Manufacturing of Urethane-Modified Crystalline Polyester Resin B-2

204 parts (1.01 mol) of sebacic acid, 13 parts (0.09 mol) of adipic acid, 136 parts (1.15 mol) of 1,6-hexane diol, and 0.5 parts of tetrabutoxy titanate as a condensing catalyst were placed in a reaction container equipped with a condenser, a stirrer, and a nitrogen introducing tube to conduct reaction at 180° C. for eight hours in a nitrogen atmosphere while distilling away produced water.

Next, reaction was conducted for four hours while gradually heating the system to 220° C. and distilling away produced water and 1,6-hexane diol in a nitrogen atmosphere. Thereafter, the reaction was continued with a reduced pressure of from 5 mmHg to 20 mmHg until the Mw reached about 20,000 to obtain [Crystalline Polyester Resin B'-2].

The thus-obtained [Crystalline Polyester Resin B'-2] had an Mw of 20,000.

The thus obtained [Crystalline Polyester Resin B'-2] was transferred to a reaction container equipped with a condenser, a stirrer, and a nitrogen introducing tube. Thereafter, 200 parts of ethyl acetate and 15 parts (0.06 mol) of 4,4'-diphenyl methane diisocyanate (MDI) were added thereto to conduct reaction at 80° C. in a nitrogen atmosphere for five hours.

Next, ethyl acetate was distilled away under a reduced pressure to obtain [Urethane-Modified Crystalline Polyurethane Resin B-2]. The thus-obtained [Urethane-Modified Crystalline Polyester Resin B-2] had an Mw of 39,000 and a melting point of 63° C.

The properties of the crystalline resins manufactured as described above are shown in Table 1.

Manufacturing of Non-Crystalline Polyester Resin 222 parts of an adduct of bisphenol with 2 mol of EO, 129 parts of an adduct of bisphenol with 2 mol of PO, 166 parts of isophthalic acid, and 0.5 parts of tetrabutoxy titanate as a condensing catalyst were placed in a reaction container equipped with a condenser, a stirrer, and a nitrogen introducing tube to conduct reaction at 230° C. for eight hours in a nitrogen atmosphere while distilling away produced water.

Next, reaction was conducted under a reduced pressure of from 5 mmHg to 20 mmHG. The system was cooled down to 180° C. when the acid value became 2 followed by an addition of 35 parts of trimellitic anhydride. Thereafter, reaction was conducted at normal pressure for three hours to obtain a non-crystalline resin. The thus-obtained non-crystalline resin had an Mw of 8,000 and a melting point of 62° C.

Styrene-(Meth)Acrylic Resin

Styrene-(Meth)Acrylic Resin C-1

A copolymer resin of styrene and n-butyl acrylate was used. The copolymer resin of styrene and n-butyl acrylate had a weight average particle diameter of 45,000 and a glass transition temperature of 61° C.

Styrene-(Meth)Acrylic Resin C-2

A copolymer resin of styrene and n-butyl acrylate was used.

The copolymer resin of styrene and n-butyl acrylate had a weight average particle diameter of 90,000 and a glass transition temperature of 62° C.

Styrene-(Meth)Acrylic Resin C-3

A copolymer resin of styrene and n-butyl acrylate was used. The copolymer resin of styrene and n-butyl acrylate had a weight average particle diameter of 30,000 and a glass transition temperature of 53° C.

Styrene-(Meth)Acrylic Resin C-4

A copolymer resin of styrene and n-butyl acrylate was used.

The copolymer resin of styrene and n-butyl acrylate had a weight average particle diameter of 100,000 and a glass transition temperature of 82° C.

Styrene-(Meth)Acrylic Resin Particulate C-1'

Particulates (average particle diameter: 30 nm) having the same composition as the styrene-(meth)acrylic resin C-1 were used.

The copolymer resin of styrene and n-butyl acrylate had the same weight average particle diameter and the same glass transition temperature as the styrene-(meth)acrylic resin C-1.

Check of Compatibility

10% by weight ethyl acetate solution of [Crystalline Polyester Resin A-1] to [Crystalline Polyester Resin A-4] and [Crystalline Polyester Resin [B-1] to [Crystalline Polyester Resin B-2] and 10% by weight ethyl acetate solution of [Styrene-(Meth)Acrylic Resin C-1] to [Styrene-(Meth)Acrylic Resin C-4] were prepared. Resin solutions of three different ratios of 1 part and 9 parts, 5 parts and 5 parts, and 9 parts of 1 part for each combination of [Crystalline Polyester Resin A-1] to [Crystalline Polyester Resin A-4] and [Styrene-

TABLE 1

| | Crystalline resin | | | | | |
|---|---|---|---|---|---|---|
| | A-1 | A-2 | A-3 | A-4 | B-1 | B-2 |
| Tm (° C.) | 60 | 62 | 64 | 57 | 65 | 63 |
| Mw | 20,000 | 22,000 | 23,000 | 9,500 | 63,000 | 39,000 |
| (Softening point/Maximum peak temperature of melting heat) | 1.08 | 1.15 | 1.26 | 1.12 | 1.33 | 1.28 |

(Meth)Acrylic Resin C-1] to [Styrene-(Meth)Acrylic Resin C-4] and [Crystalline Polyester Resin [B-1] to [Crystalline Polyester Resin B-2] and [Styrene-(Meth)Acrylic Resin C-1] to [Styrene-(Meth)Acrylic Resin C-4] were prepared. These solutions were applied onto a transparent PET film using a wire bar followed by drying. If all of the three kinds of applied films were cloudy, both resins were determined as incompatible.

Preparation of Coloring Agent Liquid Dispersion

A liquid dispersion of carbon black was prepared as a coloring agent.

17 parts of carbon black (RegaL 400, manufactured by Cabot Corporation), 3 parts of a pigment dispersant, and 80 parts of ethyl acetate were primarily dispersed using a mixer stirring wing. The pigment dispersant was AJISPER PB821 (manufactured by Ajinomoto Fine-Techno Co., Inc.).

The thus obtained primarily dispersed liquid dispersion was more dispersed more finely by a bead mill (LMZ type, manufactured by Ashizawa Finetech Ltd.; zirconia beads diameter: 0.3 mm) using a strong shearing force to remove agglomeration body not less than 5 μm completely so that a secondary liquid dispersion was prepared.

Preparation of Liquid Dispersion of Releasing Agent

Next, a liquid dispersion of releasing agent was prepared.

10 parts of carnauba releasing agent, 0.5 parts of the liquid dispersion of releasing agent, and 24.5 parts of ethyl acetate were primarily dispersed using a mixer having a stirring wing.

This primary liquid dispersion was heated to 80° C. while being stirred to dissolve the carnauba releasing agent. The system was cooled down to room temperature to precipitate releasing agent particles having a maximum particle diameter of 3 μm.

The liquid dispersion of releasing agent was a copolymer of grafting a copolymer of styrene-butyl acrylate to a polyethlene releasing agent was used. The thus obtained liquid dispersion was dispersed more finely by a bead mill (LMZ type, manufactured by Ashizawa Finetech Ltd.; zirconia beads diameter: 0.3 mm) using a strong shearing force to adjust the maximum diameter to be 1 μm or less.

Preparation of Toner Liquid Compositions A to N

Next, each liquid dispersion or solution containing the binder resin, the charge control agent, the coloring agent, and the releasing agent with a composition ratio shown in Table 2 was stirred for ten minutes by a mixer having a stirring wing to be uniformly dispersed in ethyl acetate. When the binder resin was not dissolved, it was dissolved by heating in a water bath. No pigment or releasing agent particles were agglomerated at the shock of solvent dilution.

The charge control agent was (manufactured by FUJIKURA KASEU CO., LTD.).

FCA-2508N is a negatively-charged charge control agent containing a polycondensation element obtained from polycondensation reaction between a phenolic compound and an aldehyde.

TABLE 2

| | Crystalline resin A | | Crystalline resin B | | Non-crystalline resin | Styrene-(meth)acrylic resin C | |
|---|---|---|---|---|---|---|---|
| | | Parts | | Parts | Parts | | Parts |
| Toner liquid composition A | A-1 | 57 | B-1 | 33 | 0 | C-1 | 10 |
| Toner liquid composition B | A-2 | 57 | B-2 | 33 | 0 | C-2 | 10 |

TABLE 2-continued

| | | | | | | | |
|---|---|---|---|---|---|---|---|
| Toner liquid composition C | A-1 | 60 | B-1 | 35 | 0 | C-1 | 5 |
| Toner liquid composition D | A-1 | 45 | B-1 | 25 | 0 | C-1 | 30 |
| Toner liquid composition E | A-1 | 57 | B-2 | 33 | 0 | C-1 | 10 |
| Toner liquid composition F | A-3 | 45 | B-1 | 25 | 0 | C-2 | 30 |
| Toner liquid composition G | A-4 | 57 | B-2 | 33 | 0 | C-1 | 10 |
| Toner liquid composition H | A-4 | 60 | B-1 | 35 | 0 | C-1 | 5 |
| Toner liquid composition I | A-1 | 63 | B-1 | 37 | 0 | — | — |
| Toner liquid composition J | A-2 | 57 | B-2 | 33 | 0 | C-3 | 10 |
| Toner liquid composition K | A-2 | 57 | B-2 | 33 | 10 | — | — |
| Toner liquid composition L | A-1 | 57 | B-2 | 33 | 0 | C-4 | 10 |
| Toner liquid composition M | A-1 | 57 | B-1 | 33 | 0 | — | — |
| Toner liquid composition N | A-1 | 25 | B-1 | 20 | 55 | C-1 | 10 |

| | Releasing agent (carnauba) Parts | Releasing agent dispersing agent Parts | Coloring agent (carbon black) Parts | Charge control agent (FCA-2508N) Parts | Solid portion (% by weight) Parts |
|---|---|---|---|---|---|
| Toner liquid composition A | 10 | 0.5 | 5 | 1 | 10 |
| Toner liquid composition B | 10 | 0.5 | 5 | 1 | 10 |
| Toner liquid composition C | 10 | 0.5 | 5 | 1 | 10 |
| Toner liquid composition D | 10 | 0.5 | 5 | 1 | 10 |
| Toner liquid composition E | 10 | 0.5 | 5 | 1 | 10 |
| Toner liquid composition F | 10 | 0.5 | 5 | 1 | 10 |
| Toner liquid composition G | 10 | 0.5 | 5 | 1 | 10 |
| Toner liquid composition H | 10 | 0.5 | 5 | 1 | 10 |
| Toner liquid composition I | 10 | 0.5 | 5 | 1 | 10 |
| Toner liquid composition J | 10 | 0.5 | 5 | 1 | 10 |
| Toner liquid composition K | 10 | 0.5 | 5 | 1 | 10 |
| Toner liquid composition L | 10 | 0.5 | 5 | 1 | 10 |
| Toner liquid composition M | 10 | 0.5 | 5 | 1 | 50 |
| Toner liquid composition N | 10 | 0.5 | 5 | 1 | 50 |

Example 1

Manufacturing of Mother Toner Particle A

Droplets of the toner composition liquid A were ejected from droplet ejection head by the toner manufacturing device illustrated in FIGS. 1 to 3 based on the principle of liquid column resonance illustrated in FIG. 1 under the following conditions: Thereafter, the droplets were dried and solidified followed by cyclone collecting. Thereafter, the system was secondarily dried at 35° C. for 48 hours to produce [Mother Toner Particle A].

Liquid Column Resonance Condition

Resonance mode: N=2

Distance between both ends in the liquid column resonance chamber in the longitudinal direction: L=1.8 mm Height of the end portion of frame on the side of the common liquid passage in the liquid column resonance chamber: h1=80

Height of the opening communicating the liquid column resonance chamber:

h2=40 μm

Manufacturing of Mother Toner Particle A

Specific gravity: $\rho$=1.1 g/cm$^3$

Form of ejection nozzle: True sphere

Diameter of ejection nozzle: 7.5 μm

Number of openings of ejection nozzles at ejection nozzle:

4 per liquid column resonance chamber

The least distance between the centers of adjacent ejection nozzles:

130 μm (equally distanced)

Drying air temperature: 40° C.

Applied voltage: 10.0 V

Drive frequency: 395 Hz

Manufacturing of Toner A 1.0 part of hydrophobic silica (H2000, manufactured by Clariant) serving as a fluidity improver and 1.0 part of titanium oxide (SMT-150AAI, manufactured by TAYKA CORPORATION) were added to [Mother Toner Particle A] followed by eternal addition treatment by using a HENSCHEL MIXER (manufactured by NIPPON COKE & ENGINEERING. CO., LTD.) to obtain [Toner A].

Properties of [Toner A] are shown in Table 3.

The shell structure of the thus-obtained toner was observed by a transmission type electron microscope (TEM).

Figure 15:
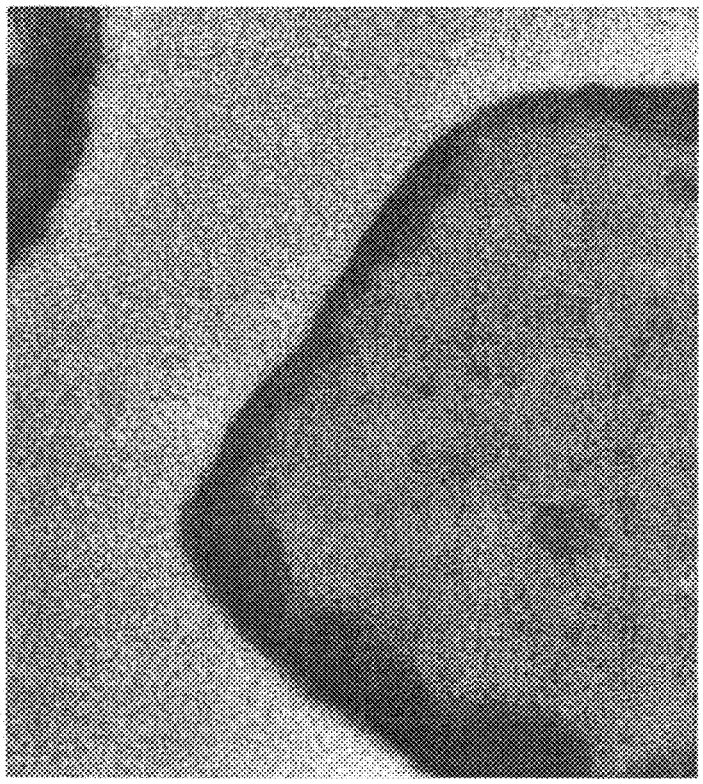
FIG. 15 is an image of an example of the toner according to an embodiment of the present invention taken by a transmission electron microscope (TEM).

The thus-obtained TEM image is shown in FIG. 15.

In the TEM image, the shell structure is shown as the black portion. The non-crystalline resin is observed to be locally present on the surface portion of the toner and form a continuous phase shell structure of the non-crystalline resin.

In the present disclosure, the shell structure is also confirmed by the results of stress resistance and damage during image transfer.

Example 2

[Mother Toner Particle B] was manufactured in the same manner as in Example 1 to obtain [Toner B] except that [Toner Composition Liquid A] was changed to [Toner Composition Liquid B]. Properties of [Toner B] are shown in Table 3.

Example 3

[Mother Toner Particle C] was manufactured in the same manner as in Example 1 to obtain [Toner C] except that [Toner Composition Liquid A] was changed to [Toner Composition Liquid C]. Properties of [Toner C] are shown in Table 3.

Example 4

[Mother Toner Particle D] was manufactured in the same manner as in Example 1 to obtain [Toner D] except that [Toner Liquid Composition A] was changed to [Toner Liquid Composition D]. Properties of [Toner D] are shown in Table 3.

Example 5

[Mother Toner Particle E] was manufactured in the same manner as in Example 1 to obtain [Toner E] except that [Toner Liquid Composition A] was changed to [Toner Liquid Composition E]. Properties of [Toner E] are shown in Table 3.

Example 6

[Mother Toner Particle F] was manufactured in the same manner as in Example 1 to obtain [Toner F] except that [Toner Liquid Composition A] was changed to [Toner Liquid Composition F]. Properties of [Toner F] are shown in Table 3.

Example 7

[Mother Toner Particle G] was manufactured in the same manner as in Example 1 to obtain [Toner G] except that [Toner Liquid Composition A] was changed to [Toner Liquid Composition G]. Properties of [Toner G] are shown in Table 3.

Example 8

[Mother Toner Particle H] was manufactured in the same manner as in Example 1 to obtain [Toner H] except that [Toner Liquid Composition A] was changed to [Toner Liquid Composition H]. Properties of [Toner H] are shown in Table 3.

Comparative Example 1

[Mother Toner Particle I was manufactured in the same manner as in Example 1 to obtain [Toner I] except that [Toner Liquid Composition A] was changed to [Toner Liquid Composition I]. Properties of [Toner I] are shown in Table 3.

Example 9

[Mother Toner Particle J] was manufactured in the same manner as in Example 1 to obtain [Toner J] except that [Toner Liquid Composition A] was changed to [Toner Liquid Composition J]. Properties of [Toner J] are shown in Table 3.

Comparative Example 2

[Mother Toner Particle K] was manufactured in the same manner as in Example 1 to obtain [Toner K] except that [Toner Liquid Composition A] was changed to [Toner Liquid Composition K]. Properties of [Toner K] are shown in Table 3.

Example 10

[Mother Toner Particle L] was manufactured in the same manner as in Example 1 to obtain [Toner L] except that [Toner Liquid Composition A] was changed to [Toner Liquid Composition L]. Properties of [Toner L] are shown in Table 3.

Comparative Example 3

[Mother Toner Particle M] was manufactured in the following manner using [Toner Liquid Composition M] to obtain [Toner M]. Properties of [Toner L] are shown in Table 3.

Preparation of Aqueous Phase 1

369 parts of deionized water, 10 parts of [Styrene-(Meth) acrylic Particulate C-1'], 13 parts of 48.5% by weight aqueous solution of sodium dodecyldiphenyl etherdisulfonate (EREMINOR MON-7, manufactured by Sanyo Chemical Industries, Ltd.), and 34 parts of ethyl acetate were mixed and stirred to obtain [Aqueous Phase].

Manufacturing of Mother Toner 426 parts of [Aqueous Phase] was placed in a reaction container equipped with a stirrer and a thermometer followed by heating to 40° C. 213 parts of [Toner Liquid Composition N] was added to [Aqueous Phase] maintained at 45° C. to 50° C. while being stirred by a TK type HOMOMIXER (manufactured by PRIMIX Corporation) at 13,000 rpm for emulsification for one minute to obtain [Emulsified Slurry].

[Emulsified Slurry] was placed in a container equipped with a stirrer and a thermometer followed by removing the solvent at 60° C. for six hours to obtain [Slurry]. The thus-obtained [Slurry] was filtered with a reduced pressure followed by the following washing treatment:

(1): 100 parts of deionized water was added to the filtered cake followed by mixed by a TK HOMOMIXER (at 6,000 rpm for five minutes);

(2): 100 parts of 10% sodium hydroxide was added to the filtered cake obtained in (1) and the resultant was mixed by a TK HOMOMIXER (at 6,000 rpm for ten minutes) followed by filtration with a reduced pressure;

(3): 82 parts of 10% hydrochloric acid was added to the filtered cake obtained in (2) and the resultant was mixed by a TK HOMOMIXER (at 6,000 rpm for five minutes) followed by filtration; and (4): 300 parts of deionized water was added to the filtered cake obtained in (3) and the resultant was mixed by a TK HOMOMIXER at a rotation number of 6,000 rpm for five minutes followed by filtration twice to obtain [Filtered Cake 1].

[Filtered Cake 1] was dried by a circulation drier at 45° C. for 48 hours. The dried resultant was screened by a mesh having an opening size of 75 μm to obtain [Mother Toner Particle M].

Comparative Example 4

[Mother Toner Particle N] was manufactured in the same manner as in Example 1 to obtain [Toner N] except that [Toner Liquid Composition A] was changed to [Toner Liquid Composition N]. Properties of [Toner N] are shown in Table 3.

Manufacturing of Carrier

The recipe specified above was dispersed by a Homomixer for 20 minutes to prepare a liquid for forming a covering layer. Using a fluid bed type coating device, the liquid for forming a covering layer was applied to the surface of 1,000 parts of spherical magnetite having an average particle diameter of 40 μm to obtain magnetic carrier.

Composition

Silicone resin (Organo straight silicone): 100 parts

Toluene 100 parts

γ-(2-aminoethyl) aminopropyl trimethoxy silane: 5 parts

Carbon Black: 10 parts

Manufacturing of Development Agent

Two component development agents were manufactured by mixing 4 parts of each of [Toner A] to [Toner N] with 96 parts of the magnetic carrier by a ball mill.

The lowest fixing temperature, the damage during transfer, the particle size distribution, and the stress resistance of each toner a two component development agent were evaluated according to the following method:

Evaluation of Particle Size Distribution

The volume average particle diameter (Dv) and the number average particle diameter (Dn) of [Toner A] to [Toner N] were measured by using a particle size measuring instrument (MULTISIZER III, manufactured by BECKMAN COULTER INC.) with an aperture diameter of 100 μm and the measuring results were analyzed by an analysis software (BECKMAN COULTER MULTISIZER 3 VERSION 3.51).

Specifically, 0.5 mL of 10% surfactant (alkyl benzene sulfonic acid salt: NEOGEN SC-A, manufactured by DAI-ICHI KOGYO SEIYAKU CO., LTD.) was put in glass beaker. Thereafter, 0.5 g of each toner was added. Subsequent to stirring by a microspatula, 80 mL of deionized water was added.

The thus-obtained liquid was subject to dispersion treatment for ten minutes by an ultrasonic wave dispersion device (W-113MK-II, manufactured by Honda Electronics). The liquid dispersion was measured by using the MULTISIZER III using ISOTON® III (manufactured by BECKMAN COULTER INC.) as the measuring solution.

The liquid dispersion was dripped such that the concentration indicated by the measuring device was from 6% to 10%. Particles having a particle diameter in a range of from 2.001 μm to 20.1874 μm were used.

After measuring the volume and the number of the toner particle or toner, the volume distribution and the number distribution were calculated. The volume weight average particle diameter (Dv) and the number average particle diameter (Dn) of the toner were obtained based on the obtained distributions.

The ratio (Dv/Dn) obtained by dividing the volume weight average particle diameter (Dv) by the number average particle diameter (Dn) was used as the index of the particle size distribution. Dv/Dn is 1 in the case of completely simple dispersion. The larger this value, the wider the distribution.

Observation of Cross Section of Toner

To confirm whether a shell layer was formed, the cross section of toner was monitored by a transmission type electron microscope (TEM) (Hitachi H7000) to confirm that the non-crystalline resin was locally present on the surface of the toner, forming a continuous phase shell structure.

The toner having a continuous phase shell structure of a non-crystalline resin locally present on the surface portion of toner was evaluated good (G) and the toner other than that was evaluated as bad (B).

Low Temperature Fixing Property (Lowest Fixing Temperature)

A single color solid image (image size: 3 cm×8 cm) having a toner attachment amount of from 0.75 mg/cm$^2$ to 0.95 mg/cm$^2$ after image transfer on a transfer sheet (photocopying paper <70>, manufactured by RICOH BUSINESS EXPERT CO., LTD.) was output using the image forming apparatus 100C illustrated in FIG. 13 followed by fixing while changing the temperature of the fixing belt.

A picture was drawn on the surface of the obtained fixed image with a drawing tester (AD-401, manufactured by UESHIMA SEISAKUSHO CO., LTD.) with a ruby needle having a tip diameter of from 260 μmR to 320 μmR with a tip angle of 60 degrees under a load of 50 g and thereafter the surface of the drawn picture was rubbed with a fiber (HONECOTTO #440, manufactured by SAKATA INX ENG. CO., LTD.) five times.

The temperature of the fixing belt at which almost no image scraping occurred was determined as the lowest fixing temperature. In addition, the solid image was formed at a position 3.0 cm from the leading end of the transfer sheet relative to the transfer direction.

The speed of the transfer sheet passing through the nipping portion of the fixing device was 280 mm/s. The lower the lowest fixing temperature is, the better the low temperature fixing property is.

Damage During Transfer

Using the image forming apparatus 100C illustrated in FIG. 13, a single color solid image having a toner attachment amount of from 0.75 mg/cm$^2$ to 0.95 mg/cm$^2$ after image transfer was formed on a transfer sheet (TYPE 6200, manufactured by RICOH Co., Ltd.) followed by fixing while the temperature of the fixing belt was set at +10° C. higher than the lowest fixing temperature of the toner. The degree of marks of the discharging roller (discharging roller 56 of FIG. 13) formed on the surface of the fixed image was evaluated by comparing the references of the damage.

The speed of the transfer sheet passing through the nipping portion of the fixing device was 280 mm/s, which was conducted using an A4 size sheet in the landscape direction. The results are shown in Table 3.

The references were arranged from bad to good with a marking of from 0 marks to 5.0 marks with an interval of 0.5 marks. Higher marks mean images with less damage.

5.0 marks indicates the degree at which no damage during transfer is visually confirmed.

3.0 marks indicates the degree at which extremely slight damage during transfer is visually confirmed.

Images with 3.0 marks or higher are acceptable

Images with 2.5 marks or lower are not acceptable.

1.0 marks indicates the degree at which damage is clearly seen.

Part of the image is shaved off so that the transfer sheet appears.

Stress Resistance

Using the image forming apparatus 100C illustrated in FIG. 13, an image having an image area ratio of 0.5% was printed on 50,000 sheets. Thereafter, a solid image was output on all over a sheet to visually confirm whether there was a portion where toner was not attached in the image area (i.e., the substrate of paper itself was seen) and evaluated according to the following criteria.

Evaluation Criteria

A (Excellent): There was no portion where toner was not attached at the image portion B (Good): There were a slight number of portions where toner was not attached at the image portion C (Fair): There were portions where toner was not attached at the image portion, but with no practical problem D (Bad): There was a number of portions portion where toner was not attached at the image portion, causing practical problems

TABLE 3

| | Toner | Peak temp. (° C.) of melting heat | Amount of melting heat (J/g) | Dv (μm) | Dv/Dn | Lowest fixing temp. (° C.) | Damage during transfer | Stress resist-ance | Cross section of toner |
|---|---|---|---|---|---|---|---|---|---|
| Example 1 | Toner A | 62 | 65 | 5.2 | 1.09 | 110 | 4.0 | B | [[B]] G |
| Example 2 | Toner B | 62 | 47 | 5.0 | 1.10 | 110 | 4.0 | B | [[B]] G |
| Example 3 | Toner C | 62 | 69 | 5.1 | 1.07 | 105 | 3.5 | B | [[B]] G |
| Example 4 | Toner D | 62 | 51 | 5.1 | 1.08 | 115 | 4.5 | A | [[B]] G |
| Example 5 | Toner E | 61 | 67 | 5.1 | 1.07 | 110 | 4.0 | B | [[B]] G |
| Example 6 | Toner F | 64 | 35 | 5.2 | 1.08 | 115 | 4.5 | A | [[B]] G |
| Example 7 | Toner G | 59 | 59 | 5.1 | 1.07 | 110 | 3.5 | B | [[B]] G |
| Example 8 | Toner H | 60 | 62 | 4.9 | 1.10 | 105 | 3.0 | B | [[B]] G |
| Comparative Example 1 | Toner I | 62 | 60 | 5.1 | 1.10 | 100 | 1.5 | D | [[D]] B |
| Example 9 | Toner J | 62 | 46 | 5.2 | 1.09 | 105 | 3.0 | C | [[B]] G |
| Comparative Example 2 | Toner K | 62 | 46 | 5.1 | 1.08 | 110 | 2.0 | D | [[D]] B |
| Example 10 | Toner L | 61 | 68 | 5.1 | 1.09 | 120 | 4.5 | B | [[B]] G |
| Comparative Example 3 | Toner M | 62 | 54 | 5.0 | 1.08 | 105 | 2.0 | D | [[D]] B |
| Comparative Example 4 | Toner N | 62 | 27 | 5.0 | 1.14 | 130 | 5.0 | A | [[B]] G |

According to the present invention, toner is provided which prevents damage to an image being conveyed in transfer paths immediately after fixing while striking a balance between low temperature fixability and stress resistance.

Having now fully described embodiments of the present invention, it will be apparent to one of ordinary skill in the art that many changes and modifications can be made thereto without departing from the spirit and scope of embodiments of the invention as set forth herein.

What is claimed is:

1. A toner, comprising a binder resin comprising:

one or more kinds of crystalline resin; and one or more kinds of non-crystalline resin, wherein:

the one or more kinds of non-crystalline resin is located at a surface portion of the toner and forms a shell structure of a continuous phase;

at least one of the one or more kinds of crystalline resin comprises at least a urethane bond or a urea bond at a main chain thereof; and the toner has an amount of melting heat of 30 J/g or more in a second temperature rising as measured by differential scanning calorimetry (DSC).

2. The toner according to claim 1, wherein the one or more kinds of non-crystalline resin comprises a resin incompatible with the one or more kinds of crystalline resin.

3. The toner according to claim 2, wherein the one or more kinds of non-crystalline resin incompatible with the one or more kinds of crystalline resin is a styrene-(meth)acrylic resin.

4. The toner according to claim 1, wherein the one or more kinds of non-crystalline resin accounts for from 5% by weight to 30% by weight based on the binder resin and has a glass transition temperature Tg of from 55° C.

5. The toner according to claim 1, wherein the binder resin comprises two crystalline resins, each comprising at least a urethane bond or a urea bond at a main chain thereof.

6. The toner according to claim 1, wherein the one or more kinds of crystalline resin comprises a first crystalline resin and a second crystalline resin having a weight average molecular weight Mw greater than the first crystalline resin.

7. The toner according to claim 1, further comprising a charge control agent comprising a polycondensation element formed by polycondensation reaction of a phenolic compound and an aldehyde.

8. The toner according to claim 1, wherein, in CHN analysis of a portion in the toner which is soluble in tetrahydrofuran (THF), an amount of nitrogen accounts for from 0.3% by weight to 2.0% by weight.

9. The toner according to claim 1, wherein the one or more kinds of crystalline resin accounts for 50% by weight or more based in the binder resin.

10. The toner according to claim 1, manufactured by discharging a toner composition liquid comprising a toner composition containing at least the binder resin through a piercing hole to obtain droplets.

11. A development agent, comprising:

a carrier; and the toner of claim 1.

12. An image forming apparatus, comprising:

a latent electrostatic image bearing member;

a latent electrostatic image forming device to form a latent electrostatic image on the latent electrostatic image bearing member;

a development device to develop the latent electrostatic image with the toner of claim 1 to form a visible image;

a transfer device to transfer the visible image to a recording medium; and a fixing device to fix the visible image on the recording medium.

13. The toner according to claim 1, wherein the amount of melting heat of the toner ranges from 35 J/g to 69 J/g.

14. The toner according to claim 1, wherein at least one of the one or more kinds of crystalline resin is a crystalline polyurethane resin.

15. The toner according to claim 1, wherein at least one of the one or more kinds of crystalline resin is a urethane-modified crystalline polyester resin.

16. The toner according to claim 1, wherein at least one of the one or more kinds of crystalline resin is a crystalline polyurea resin.

* * * * *